US010814172B1

(12) United States Patent
Ilfrey et al.

(10) Patent No.: US 10,814,172 B1
(45) Date of Patent: Oct. 27, 2020

(54) EXERCISE EQUIPMENT AND SYSTEMS

(71) Applicant: QUICKHIT INTERNATIONAL, INC., Onalaska, WI (US)

(72) Inventors: Patrick Ilfrey, Onalaska, WI (US); Jeffrey Powell, Holmen, WI (US)

( * ) Notice: Subject to any disclaimer, the term of this patent is extended or adjusted under 35 U.S.C. 154(b) by 29 days.

(21) Appl. No.: 16/501,345

(22) Filed: Mar. 28, 2019

Related U.S. Application Data

(60) Provisional application No. 62/917,097, filed on Nov. 20, 2018, provisional application No. 62/761,557, filed on Mar. 29, 2018.

(51) Int. Cl.

| | |
|---|---|
| ***A63B 24/00*** | (2006.01) |
| ***A63B 21/002*** | (2006.01) |
| ***A63B 21/005*** | (2006.01) |
| ***A63B 21/00*** | (2006.01) |
| ***A63B 23/035*** | (2006.01) |

(52) U.S. Cl.
CPC ..... *A63B 24/0087* (2013.01); *A63B 21/002* (2013.01); *A63B 21/0023* (2013.01); *A63B 21/0058* (2013.01); *A63B 21/153* (2013.01); *A63B 21/156* (2013.01); *A63B 23/035* (2013.01); *A63B 24/0062* (2013.01); *A63B 21/154* (2013.01); *A63B 2024/0093* (2013.01); *A63B 2220/54* (2013.01); *A63B 2220/803* (2013.01); *A63B 2225/102* (2013.01)

(58) Field of Classification Search
CPC . A63B 24/0087; A63B 21/153; A63B 21/156; A63B 23/035; A63B 21/0058; A63B 21/002; A63B 24/0062; A63B 21/0023; A63B 21/154; A63B 2024/0093; A63B 2220/54; A63B 2225/102; A63B 2220/803
See application file for complete search history.

(56) References Cited

U.S. PATENT DOCUMENTS

| | | | | |
|---|---|---|---|---|
| 4,765,613 A * | 8/1988 | Voris | A63B 21/0056 | 482/137 |
| 5,105,926 A * | 4/1992 | Yoshimura | F16H 61/143 | 477/169 |
| 5,117,170 A | 5/1992 | Keene et al. | 318/646 | |
| 5,328,429 A * | 7/1994 | Potash | A63B 21/0058 | 482/4 |
| 5,653,669 A * | 8/1997 | Cheng | A63B 21/154 | 482/112 |

(Continued)

*Primary Examiner* — Sundhara M Ganesan
(74) *Attorney, Agent, or Firm* — Chris Whewell

(57) ABSTRACT

Exercise machines and methods are provided for purposes of increasing a person's physical fitness. The systems are computer-controlled and are devoid of any stacks of weights associated with conventional exercise equipment. The systems feature isotonic modes, isokinetic modes, isometric modes and hybrid exercise modes. The systems are programmed to be suited to a particular individual user, based on their range of motion for a particular selected exercise and body part, which is determined during an initialization process. Force experienced by users is not dampened, and forces experienced by a user are responsive by the system to the force input by the user. In some embodiments the position of a user's limb is employed as an input for determining the torque output of a resistance unit which supplies resistive force for undertaking a selected exercise.

18 Claims, 24 Drawing Sheets

(56) References Cited

U.S. PATENT DOCUMENTS

| | | | | |
|---|---|---|---|---|
| 5,738,611 | A * | 4/1998 | Ehrenfried | A63B 21/023 482/129 |
| 6,338,701 | B1 * | 1/2002 | Webber | A63B 21/154 482/138 |
| 6,582,346 | B1 * | 6/2003 | Lines | A63B 21/154 482/102 |
| 7,682,287 | B1 * | 3/2010 | Hsieh | A63B 21/00196 482/1 |
| 8,105,206 | B2 | 1/2012 | Rindfleisch | 482/6 |
| 8,388,499 | B1 | 3/2013 | Rindfleisch | 482/6 |
| 8,900,099 | B1 * | 12/2014 | Boyette | A63B 23/1281 482/5 |
| 2005/0239600 | A1 * | 10/2005 | Liang | A63B 21/4043 482/1 |
| 2007/0155587 | A1 * | 7/2007 | Huang | A63B 21/0058 482/1 |
| 2014/0038777 | A1 * | 2/2014 | Bird | A63B 21/151 482/5 |
| 2014/0194250 | A1 * | 7/2014 | Reich | A63B 24/0062 482/5 |
| 2016/0101322 | A1 * | 4/2016 | Potter | A63B 21/002 482/6 |
| 2016/0114211 | A1 * | 4/2016 | Schmidt | A63B 71/0622 482/5 |
| 2017/0361166 | A1 * | 12/2017 | Hong | A63B 21/154 |
| 2018/0214729 | A1 * | 8/2018 | Rubin | A63B 21/0058 |
| 2019/0076691 | A1 * | 3/2019 | Smith | A63B 21/0058 |
| 2019/0099632 | A1 * | 4/2019 | Orady | A63B 71/0054 |
| 2019/0160324 | A1 * | 5/2019 | Leopoldo Da Camara Filho | A63B 24/0087 |
| 2020/0069993 | A1 * | 3/2020 | Kumelis | A63B 21/0051 |

* cited by examiner

EXERCISE EQUIPMENT AND SYSTEMS

TECHNICAL FIELD

This invention relates generally to exercise and physical fitness. More particularly, it relates to equipment useful for exercising the human body and systems useful in controlling and monitoring the equipment provided.

BACKGROUND OF THE INVENTION

The statements in this background section merely provide background information related to the present disclosure and may not constitute prior art.

It is known in the art of physical fitness that individuals performing physical exercise are capable of providing more force during a the phase of exercise in which muscle tissue is undergoing lengthening (eccentric phase), than during the phase of exercise in which muscles are contracting (contracting phase). It is also known in the art that it is beneficial in terms of efficiency to load muscles during exercise in a way that is proportional to the strength of the muscles. Accordingly, it can be deemed desirable for purposes of both efficiency and efficacy to load muscles during the eccentric phase of exercise with more resistive force than during the concentric phase of exercise.

Conventional exercise equipment provides a constant weight against which a person exerts force, which never matches the person's maximal force output at essentially any point during the exercise of muscles. In fact, the maximal weight used must be no greater than the minimal force that a person can provide during their weakest point during the concentric phase of exercise.

There is one mode of exercise known in the art as isointertial training, which employs a weighted flywheel which the user can load with a force during the concentric phase of exercise, which energy is subsequently returned to the person as a force during the eccentric phase of exercise. However, devices employing this strategy require the person to have excellent balance and proper form, as they are capable of exerting significant mechanical shocks that can present serious safety issues for many users.

U.S. Pat. No. 5,328,429 describes a system whereby the force applied during the eccentric motion is resisted by a constant force. While some embodiments concern the use of concentric force, the system does not enable a dynamic force curve in which the applied force is not constant. The 429 patent does not take the user's range of motion into consideration and instead relies on the velocity of the weight stack to determine when force is applied. One disadvantage is that the mechanism can fail as a user becomes fatigued—waiting in a stationary position during concentric motion would trigger the eccentric force.

U.S. Pat. No. 5,117,170 describes a system employing a DC motor as a replacement for a weight stack, but does not enable a user to experience a non-constant force curve. Moreover, the 170 patent neglects users having a limited range of motion or desiring only to exercise over a subportion of their full bodily motion capabilities and accordingly does not enable the "soft start" it describes to disengage during such use.

U.S. Pat. No. 4,765,613 describes a mechanism for changing the applied force during an exercise motion for both the eccentric and concentric phases of exercise, but is limited in that only concentric motion may have an increasing force curve, and only eccentric motion may have a decreasing force curve. This is considered as being a resistance machine, and the force applied during eccentric motion tends towards zero and cannot selectively achieve user-specified values for this parameter.

U.S. Pat. No. 5,105,926 describes a mechanism by which several exercise modalities may be achieved, but lacks provision for limiting an exercise to a predetermined range of motion, and for determining and effecting when eccentric and concentric motion should transition. This device appears to define a motor unit, but provide no example of how it might be utilized in conjunction in a practical scenario. An electro-rheological fluid is employed to mediate the application of force.

While the foregoing and other workers in the prior art have attempted to address many of the same concerns regarding the limitations of conventional exercise equipment, each are limited to only a subset of desired modalities and typically require a plurality of sensors to track a user's position and are problematic in several other aspects, which are solved by the present invention. Devices of the prior art require custom built exercise equipment to function, and can perform only those exercises for which they are specifically designed.

Moreover, many prior art systems require a trainer or helper be present to aid in operating the exercise equipment for the user. Safety in prior art exercise equipment is heavily dependent on the user performing all exercises, and a second person or spotter is generally required for exercises in which fatigue can put a person in a dangerous situation. In addition to other advantages which will become apparent from reading this specification, the present invention eliminates the need for a second person to assist in equipment operation.

It is known in the art that during physical exercise, a person is capable of providing more force during a muscle lengthening motion (eccentric motion) than during motion in which muscle tissue is contracting (concentric motion). However, due to its isotonic nature, prior art exercise equipment provides an equivalent resistance force during both the eccentric and concentric phases of motion experienced during repetitive physical exercises, and is incapable of matching a user's maximal force output for essentially all points in time during an exercise. Isotonic exercise systems of the prior art using weight stacks are limited to using a maximal weight which can be no greater than the minimal force the user is able to provide during the concentric phase of exercise motion. Moreover, such prior art equipment and devices fail to account for proper loading of the user's musculature during exercise, resulting in an exercise which is heavily biased towards the weakest areas of the user's range of motion, as opposed to properly exercising the entire range of the person's motion during an exercise.

SUMMARY OF THE INVENTION

Provided are exercise machines for enhancing physical fitness of human subjects. The machines are selectively operable in any mode selected from the group consisting of: isokinetic mode, isometric mode, isotonic mode, and isoinertial mode; however, hybrid modes incorporating features of the foregoing individual modes are also enabled. In general, the machines comprise a rigid frame, an electrical motor attached to the frame, the motor having a motor shaft. There is a microprocessor having inputs and outputs, and the microprocessor is in effective electrical communication with the motor sufficiently to effect selective control of the direction of rotation, speed of rotation, and torque output of the motor shaft. In some embodiments there is a computer-readable memory in effective electrical communication with the microprocessor, for storing data gathered, and machine instructions. A position sensor configured to determine the position of the motor shaft is provided, and the position sensor has an output which is fed to the microprocessor as an input. There is a torque sensor configured to determine the torque output of the motor, and the torque sensor has an output which is fed to the microprocessor as an input. There is a first cable having a first end and a second end, the first and the second ends of the first cable each comprising a resistance access point, and the first cable is attached to the frame by a plurality of stationary pulleys anchored to the frame. The first cable is routed around a first mobile pulley, a central mobile pulley, and a second mobile pulley, as shown in the figures. There is a second cable having a first end and a second end, with the first and the second ends of the second cable each comprising a resistance access point. The second cable is attached to the frame by a plurality of stationary pulleys anchored to the frame. The second cable is routed around a third mobile pulley, as depicted in the drawings. There is a third cable having a first end and a second end, with the first and the second ends of the third cable each comprising a resistance access point. The third cable is attached to the frame by a plurality of stationary pulleys anchored to the frame. The third cable is routed around a fourth mobile pulley, as illustrated. There is a fourth cable having a first end and second end, and the first end of the fourth cable is attached to the shaft of the motor. The fourth cable is in effective mechanical contact with the central mobile pulley sufficiently to cause changes in the tension of the first cable, the second cable, and the third cable responsively to the torque output of the motor. There is a load cell configured to determine force experienced by the central mobile pulley, and the load cell has an output which is fed to the microprocessor as an input. The microprocessor is configured to selectively and independently cause changes in any one, or more than one output feature of the motor selected from the group consisting of: direction of rotation, speed of rotation, and torque output, responsive to changing forces applied by a human subject to any of the resistance access points, and in some embodiments to programming instructions resident in computer-readable memory.

BRIEF DESCRIPTION OF THE DRAWINGS

The drawings shown and described herein are provided for illustration purposes only and are merely exemplary of different embodiments provided herein, not intended to be construed in any delimitive fashion.

DETAILED DESCRIPTION

The following description is merely exemplary in nature and is in no way intended to limit the present disclosure, application, or uses.

Figure 1:
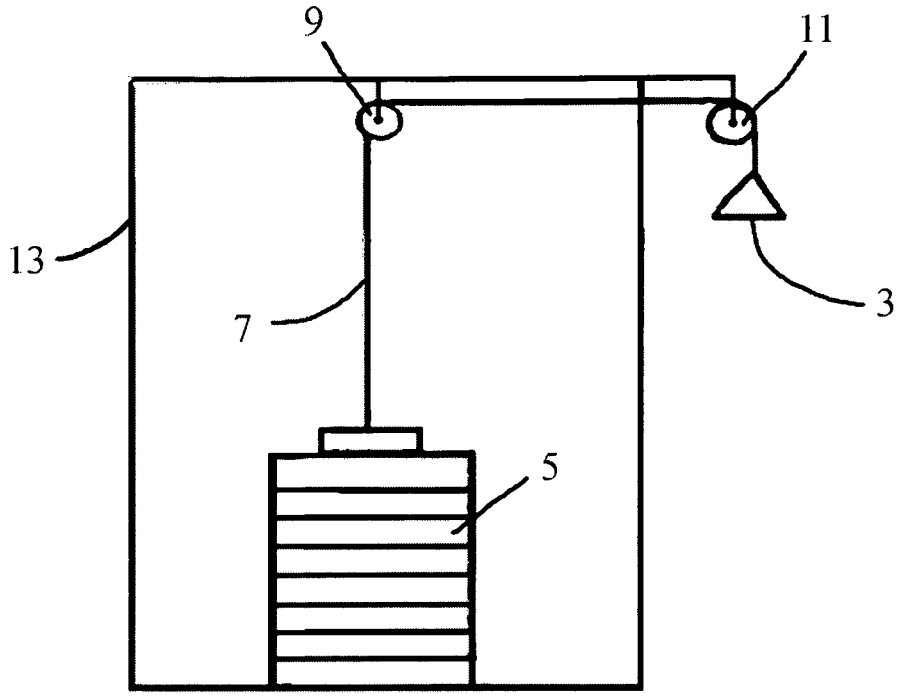
FIG. 1 (PRIOR ART)
FIG. 1 is a schematic representation of general aspects of prior art exercise machines.

Referring now to the drawings, and initially to FIG. 1, there is shown a schematic representation of a prior art arrangement which enables a person to perform physical exercise. Such arrangements generally include a frame 13, which has a plurality of pulleys 9,11 rigidly attached thereto, and a chain, rope or other strand or cable 7 having a first end and a second end. Typically, the first end of cable 7 is attached to a load, which can be a weight or an adjustable weight stack 5, and the second end of cable 7 is equipped with, or mechanically connected to a gripping provision or handle so as to provide a resistance access point 3. A person can grip the gripping provision at the resistance access point 3, and pull on it against the force of gravity acting on weight stack 5 and cable 7, thereby exercising the muscles in the limb which is pulling against the force at resistance access point 3. This simple arrangement provides two modes of exercise, a first mode as described in which a person is pulling against the force provided by the weight stack as it rises upwards responsive to the force applied by the person, and a second mode in which the person provides a resisting force as they slowly permit cable 7 to be drawn downwards as the weight stack moves downwards from an elevated position to the rest position shown in FIG. 1.

Figure 2:
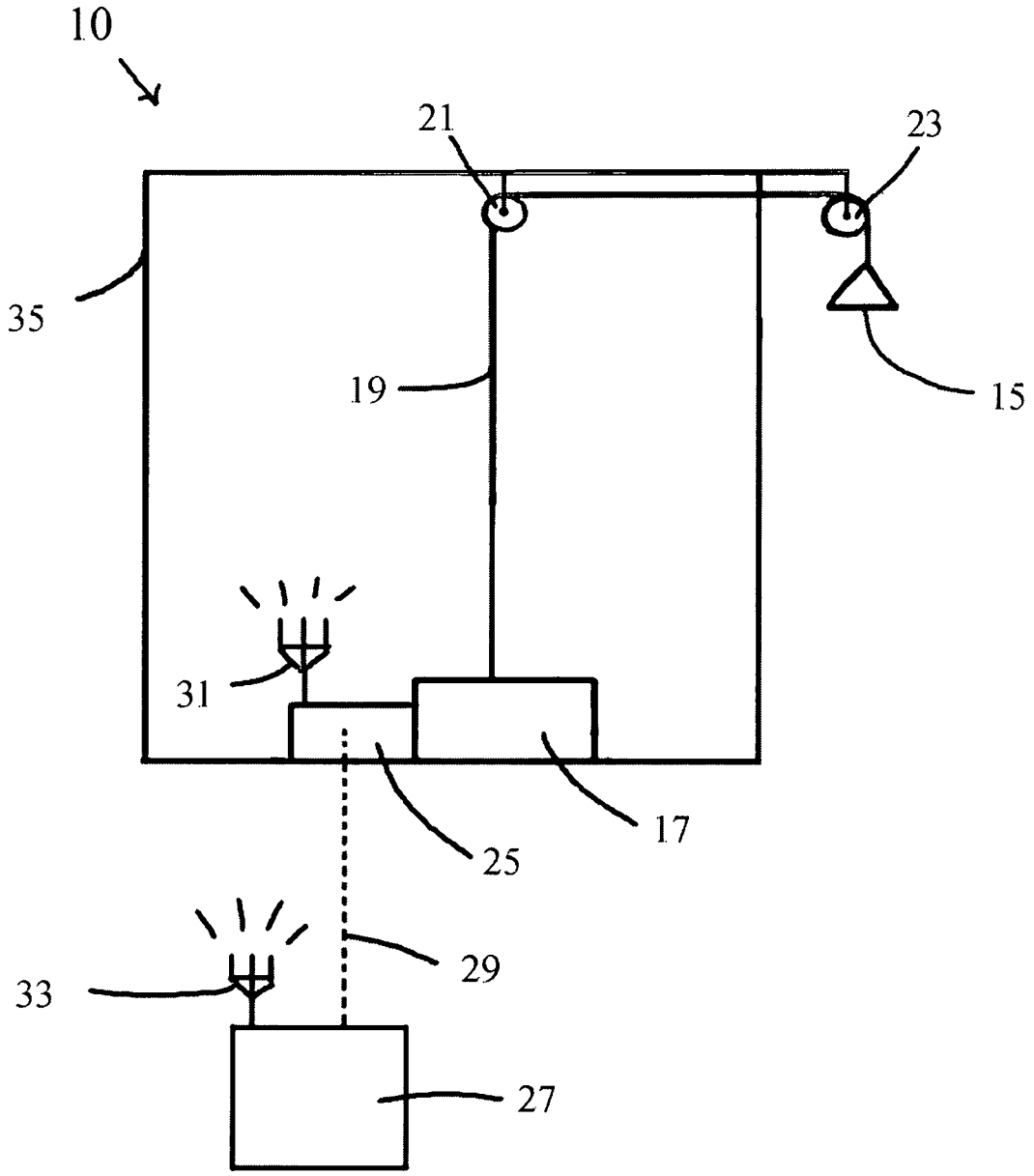
FIG. 2 is a schematic representation of general aspects of an exercise system useful in accordance with some embodiments of the disclosure.

FIG. 2 is a general schematic representation of an exercise system according to some embodiments of this disclosure, which is provided with a frame 35, a plurality of stationary pulleys 21, 23 and a cable 19 as described previously with reference to FIG. 1. However, in some embodiments provided, weight stack 5 of prior art as shown in FIG. 1 is replaced by a resistance unit 17. Resistance unit 17 in general includes a rotatable shaft disposed perpendicularly, and in some embodiments substantially-perpendicularly, to the direction of motion of cable 19, sufficiently to enable cable 19 to be drawn up by, or wrapped around such rotating shaft. As used herein, the term "rotatable shaft" means a shaft or any shaft-like construct having a longest length dimension and an axis which can be considered an axis of rotation, which axis coincides with or is substantially parallel to the longest length dimension of the shaft, and which is capable of being rotated about such axis. One non-limiting example of a rotatable shaft is a bar of steel or other metal or metallic alloy or any selected composite material, which is circular in cross-section. However, rotatable shafts having other cross sections than circular are suitable including those having an oval, ovoid, triangular, square, lobe-like (viz., automotive camshaft), or irregular or regular polygonal cross-section having any number of sides between four and twelve, including four and twelve. In many embodiments, the rotatable shaft is round in cross section. Generally, each end of the rotatable shaft is equipped with a bearing or bearing surface, to enable smooth rotation. In some embodiments the bearing is lubricated by oil. Roller bearings are also suitable.

As described below in further detail, the rotatable shaft present in or on resistance unit 17 is mechanically coupled or linked to a motor 25, which can be an AC motor and in some embodiments is a DC motor. Essentially any type of electrically-driven motor is suitable for use in accordance with the teachings of this disclosure, including stepper motors if sufficiently controlled such as by use of a servo with a rotary encoder. Brushless DC motors are also suitable. In some embodiments, permanent magnet synchronous motors are employed, such as model 180ST-M27010 available from Hang Zhou Mige Electric Company of China, and substantial equivalents thereof. These typically comprise a rotary encoder which provides a data output or signal reflective of the position of the shaft of the motor in real time. In some embodiments the motor 25 is reversible which means it is capable of operating with its armature or shaft turning in both the clockwise and counterclockwise directions, as viewed from an end perspective.

Motor 25 can be operable on essentially any voltage in the range of between one hundred 100 Volts and 440 Volts, with 380 Volts being typical in some embodiments. Motor 25 can have any power rating in the range of between one thousand Watts and four thousand Watts, with three thousand Watts being typical for some embodiments. Thus, the current in amperes used by motor 25 is any current in the range of between about two Amperes and twelve Amperes, with 8 Amperes being typical in some embodiments. Motor 25 is selected to have any torque output in the range of between five Newton-meters and a peak of about sixty-seven Newton-meters, with a static torque of about 27 Newton-meters being exemplary for some embodiments.

The energization or application of a driving voltage to motor 25, and its switching off, can be accomplished in the usual fashions known by persons of ordinary skill in the art, who are at electrical engineers having at least a bachelor's degree and often having advanced degrees.

For controlling the operation of motor 25, a motor controller 27 is present in an exercise system 10 according to this disclosure. Motor controller 27 is essentially effectively in communication with motor 25, and the communication between motor 25 and motor controller 27 can be by hard wiring such as by a wiring cable 29 shown in FIG. 2 by a dashed line, wiring cable having a sufficient number of conductors to carry out effective communication between motor 25 and motor controller 27 to enable motor controller 27 to selectively energize motor 25 to operate in a first directional rotation, and to selectively energize motor 25 to operate in a second directional rotation, and to switch off voltage applied to motor 25 so as to cause its cessation of operation. In some embodiments such operation is analogous to the operation of elevators employed in office buildings since even the $20^{th}$ century.

In some embodiments, communication between motor 25 and motor controller 27 is provided by wireless communication, via antennas 31, 33 disposed in proximity to motor 25 and motor controller 27, respectively. This enables remote location of motor controller 27 with respect to exercise system 10, which means the controller can be present at a location that is distant from exercise system 10 of any distance, being limited only by the power of the transmitters of RF energy present at motor 25 and motor controller 27. Such remote control of similar devices is known www(DOT).demagcranes(DOT)com/en-us/products/cranes/universal-cranes/v-type-crane.

The antenna 31 present in proximity to motor 25 is effectively connected to an RF processing device, which in some embodiments is a radio transceiver 217 (FIG. 12) capable of receiving and transmitting electronic signals over radio frequencies, which can be any frequencies commonly employed in wireless control of electronic equipment and the like. The useful range of frequencies can be any frequency between one megahertz and six gigahertz, and can employ any protocol of the IEEE 802.11 series of protocols, in addition to any of the IEEE 802.15 protocols. As specified earlier, motor 25 can be controlled by either by hard wire cable communication, or wirelessly, and communication with the motor in some embodiments utilizes the RS232 communications protocol (as contained in and decoded from packets in the parent communications protocol, such as IEEE 802.15. However, any communications with motor 25 can be achieved with RS485 or even a higher level protocol such as TCP/UDP, as those skilled in the art readily understand from this specification.

Similarly, the antenna present in proximity to motor controller 27 is effectively connected to an RF processing device, which in some embodiments is a radio transceiver capable of receiving and transmitting electronic signals over radio frequencies, which can be any frequencies commonly employed in wireless control of electronic equipment and the like. The useful range of frequencies can be any frequency between one megahertz and six gigahertz, and can employ any of the earlier-recited communications and control protocols.

Each of the RF processing devices associated with motor 25 and motor controller 27 further include a processor, which can be a microprocessor having inputs and outputs. Inputs to the microprocessor associated with motor 25 include electronic signals received via antenna 31 having instructions provided by the microprocessor associated with antenna 33. The microprocessor associated with motor 25 processes the signals received and transforms them into commands which control the operation of motor 25, responsive to commands or programming containing commands inputted to a microprocessor which is in effective electrical communication with antenna 33. By such arrangement, a user can input instructions, commands and computer programs containing instructions and/or commands to a microprocessor associated with motor controller 27, and effectively control the operation of resistance unit 17. This function is analogous to systems employed in radio-controlled aircraft either hobbyist models, or military drone technology for controlling a motor speed and torque, including pre-programmed process steps in the form of computer code for controlling these parameters.

Also shown in FIG. 2 is exercise point grip 15 which is disposed at a resistance access point, that is, a point at which resistance provided by rotatable shaft can be accessed, as it is transmitted or conveyed by cable 19. In many embodiments a grip such as exercise point grip 15 is configured to be grasped by a person desiring to perform physical exercise.

Figure 3:
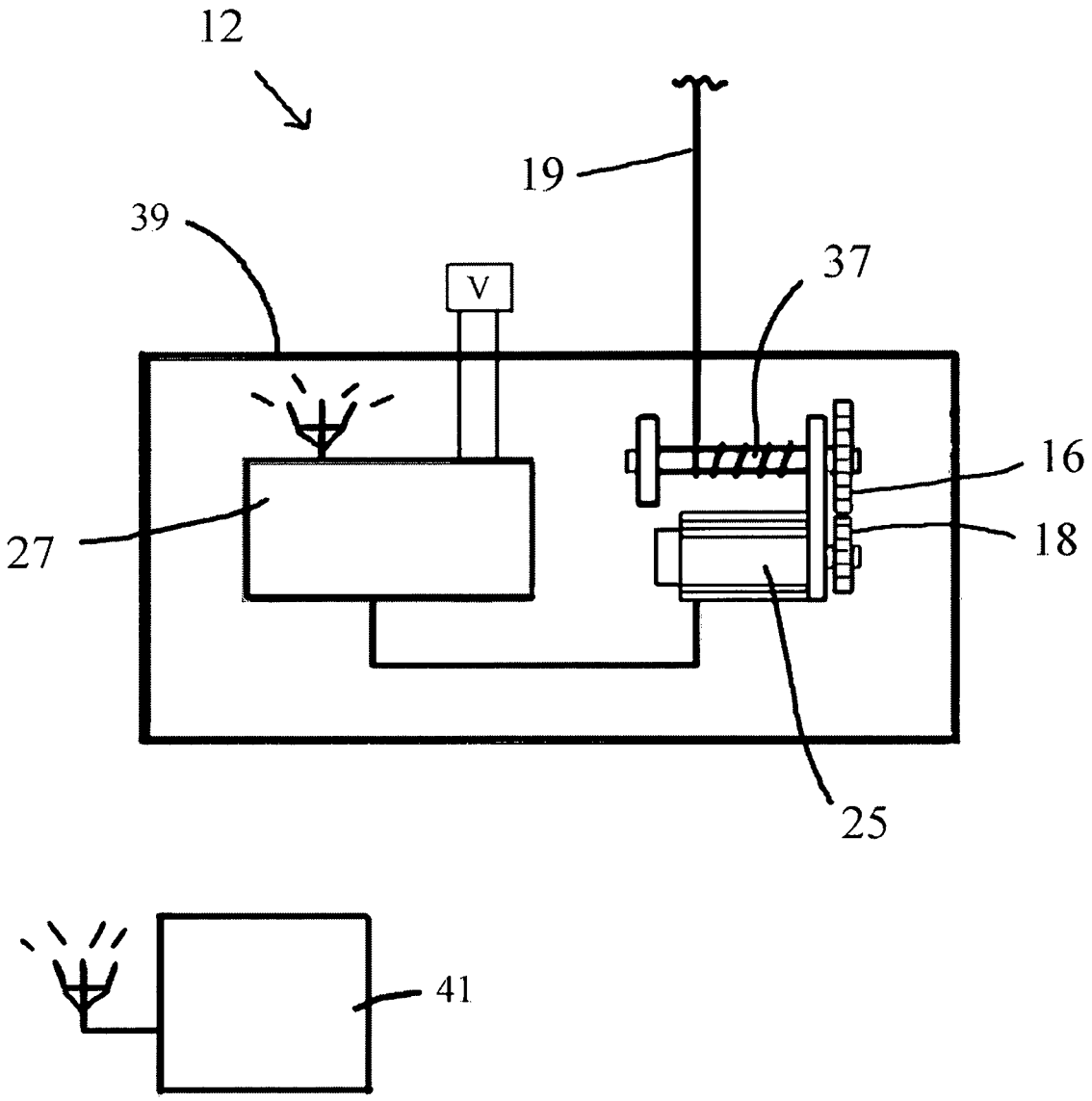
FIG. 3 is a schematic representation of a wirelessly controlled resistance unit useful in accordance with some embodiments of the disclosure.

FIG. 3 is a schematic illustration of a resistance unit according to some embodiments of the disclosure, showing the general arrangement of a rotatable shaft 37 mechanically linked to motor 25 by a shaft gear 16 disposed at the end of rotatable shaft and a motor gear 18 disposed at the end of the shaft 26 (FIGS. 5, 7) of motor 25, wherein shaft gear 16 and motor gear 18 are dimensioned and disposed to mesh with one another. The gear ratio of that of motor gear 18 to shaft gear 16 is any gear ratio in the range of between about 1.4-to-one and 3-to-one, in favor of the motor, with a gear ratio of about two to one in favor of the motor being suitably employed in some embodiments. Any type of meshing gears can be employed and alternate embodiments include the use of pulleys in the place of gears, the pulleys being furnished with a drive belt, chain or like article commonly about them to provide the effective ratios set forth above for the gear ratios. In some embodiments a toothed belt is employed, such as the type employed as drive belts on motorcycles and accessory belts in automotive engines. However, since gear ratio is somewhat dependent on the raw power available to the motor 25, choosing a suitable motor capable of high torque at high speed and low speed can obviate the need for any gearing, and the present invention includes embodiments having no gearing between the shaft of motor 25 and rotatable shaft 37.

In FIG. 3 motor 25 is electrically connected to motor controller 27, having an antenna which enables it to send and receive signals and information to and from remote controller unit 41, which has the same functions as previously described for motor controller 27 with reference to FIG. 2. That is, motor controller 27 can itself be remotely controlled by a still further, remotely disposed remote controller unit 41. Such arrangement provides for control of the speed, direction of rotation and torque output of motor 25 from any location remote from exercise system 10.

The source of EMF for the motor 25 and motor controller 27 is shown as V in FIG. 3, connected to motor controller 27, however the present disclosure includes embodiments in which the EMF is directly connected to motor 25, regulation being provided by motor controller 27 carrying out any one or more than one of the functions of breaking the circuit, switching the polarity, or varying the resistance in the lines supplying EMF to motor 25, independently, as is customary in such circuits.

Figure 4:
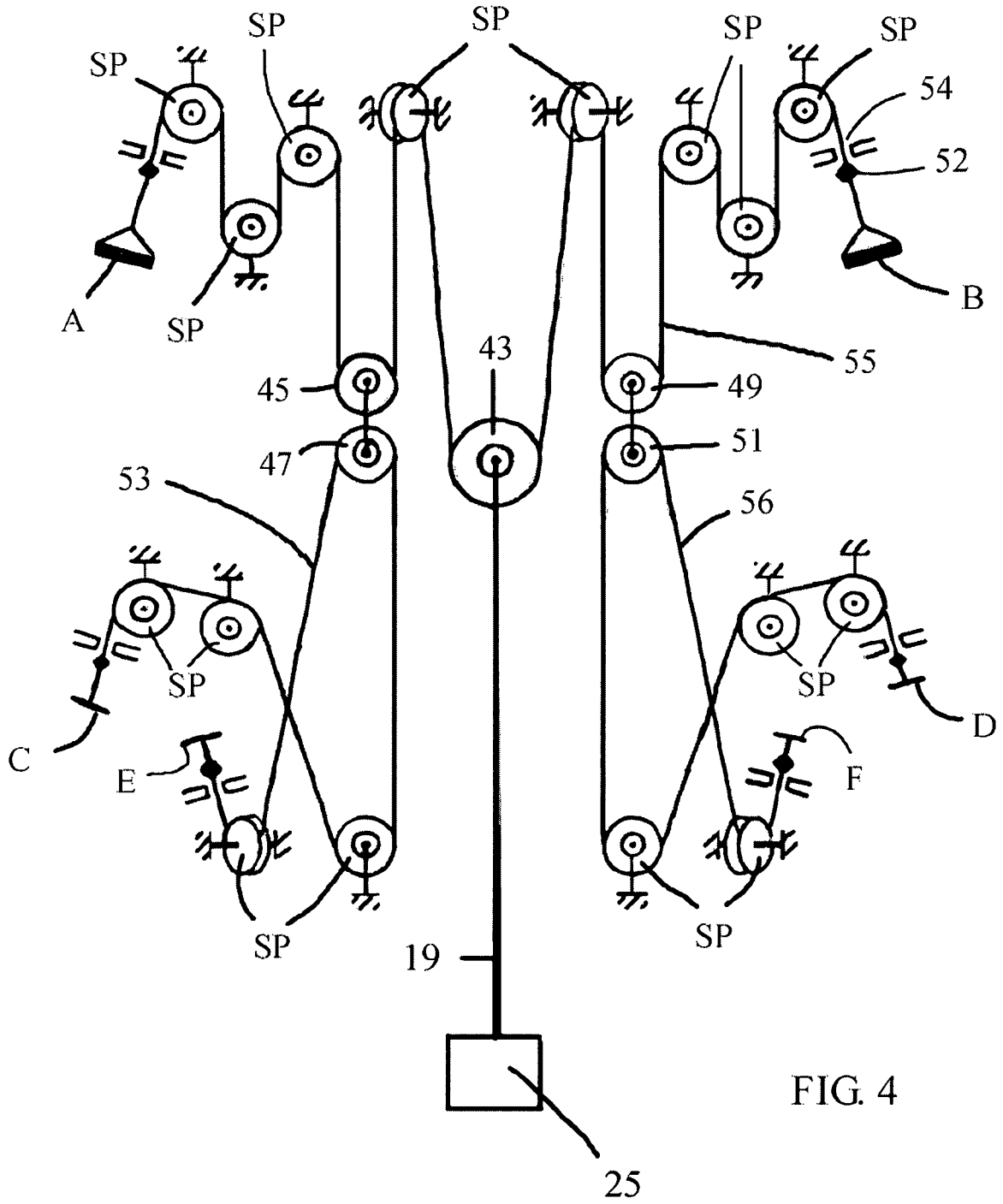
FIG. 4 is a schematic representation of a cable and pulley network useful in providing an exercise system in accordance with some embodiments of the disclosure.

FIG. 4 is a representation of a mechanical arrangement between various pulleys and cables as shown, which arrangement is useful in some embodiments of the present disclosure. Generally speaking, a system according to the invention includes two types of pulleys. One of the types of pulleys can be considered as stationary pulleys, since stationary pulleys are rigidly attached to the frame 35 of the system or equipment, and their motion is restricted to only the rotation of the pulley itself and some small amount of sideways or lateral movement, which while significant is not of particular significance for the overall function of the system or particular piece of equipment embodying some or all aspects of the present disclosure. Mobile pulleys on the other hand, are not rigidly attached to the frame 35 and are themselves free to move longitudinally in an amount that is significant to beneficially impact and is integral to the overall function of an exercise system according to this disclosure.

In FIG. 4 is shown cable 19, having a first end which is attached to mobile pulley 43, and a second end which was shown in FIG. 3 wrapped around rotatable shaft 37. Additional mobile pulleys shown in FIG. 4 are mobile pulley 45, mobile pulley 47, mobile pulley 49, and mobile pulley 51. The first end of cable 19 is attached to the center of mobile pulley 43, such as at a pin, rod, rivet or other article disposed through pulley 43 at its point or axis of rotation. Strung around mobile pulley 43 is cable 55, which cable 55 is also strung around mobile pulley 45 and mobile pulley 49, and disposed about the stationary pulleys at the top of FIG. 4. In addition, cable 55 is further strung around three stationary pulleys SP to the upper left of mobile pulley 45 in FIG. 4, as shown, providing a resistance access point at the first end of cable 55 at A. Further, cable 55 is further strung around three stationary pulleys SP to the upper right of mobile pulley 49 in FIG. 4, as shown, providing a resistance access point at the second end of cable 55 at B. Shown with reference to resistance access point B is a knot 52 associated with an opening 54 wherein the knot 52 is larger than the opening 54 so as to preclude cable 55 from being drawn into the system of pulleys beyond knot 52. Although knot 52 in some embodiments is a knot when a rope is employed as cable 55, since resistance unit 12 is suitable for mating with any weight-stack type device, the termination of cabling about the pulley system can essentially be almost anything. Other functionally-equivalent configurations are suitable, including attachment of a ball having a bore therethrough about cable 55 at the location shown, or through the use of ferrules, a loop/thimble-eye, and even the absence of a termination point, wherein the cable is affixed directly to any selected handle. Although not specifically labeled, resistance access points A, C, D, E, and F are equipped with like provisions, and can in alternate embodiments independently have any selected feature mentioned herein. Thus, a user pulling on resistance access point B will feel the force provided by cable 19 wrapped around rotatable shaft 37, acting through cable 55. The same is true for a user pulling on resistance access point A. Moreover, the same is true for a user pulling on resistance access points C, D, E, and F. Cable 55 may be referred to as being a first cable.

Cable 53 is routed about mobile pulley 47 and four stationary pulleys, as shown, its first end comprising resistance access point C and its second end comprising resistance access point E. Thus, a user pulling on resistance access point C and/or E will feel the force provided by cable 19 wrapped around rotatable shaft 37, acting through cable 53. Cable 53 may be referred to as being a second cable.

Cable 56 is routed about mobile pulley 51 and four stationary pulleys, as shown, its first end comprising resistance access point D and its second end comprising resistance access point F. Thus, a user pulling on resistance access point D and/or F will feel the force provided by cable 19 wrapped around rotatable shaft 37, acting through cable 56. Cable 56 may be referred to as being a third cable.

By the arrangement of FIG. 4, an effective resistance can be experienced by a user at each of resistance point A, resistance point B, resistance point C, resistance point D, resistance point E, resistance point F. This is true whether a user pulls solely on any one of the foregoing resistance points, or simultaneously in any combination. At the same time, the resistive force(s) experienced are not due to a conventional weight stack, but rather resistance unit 12 or resistance unit 17, whichever is selected.

Figure 5:
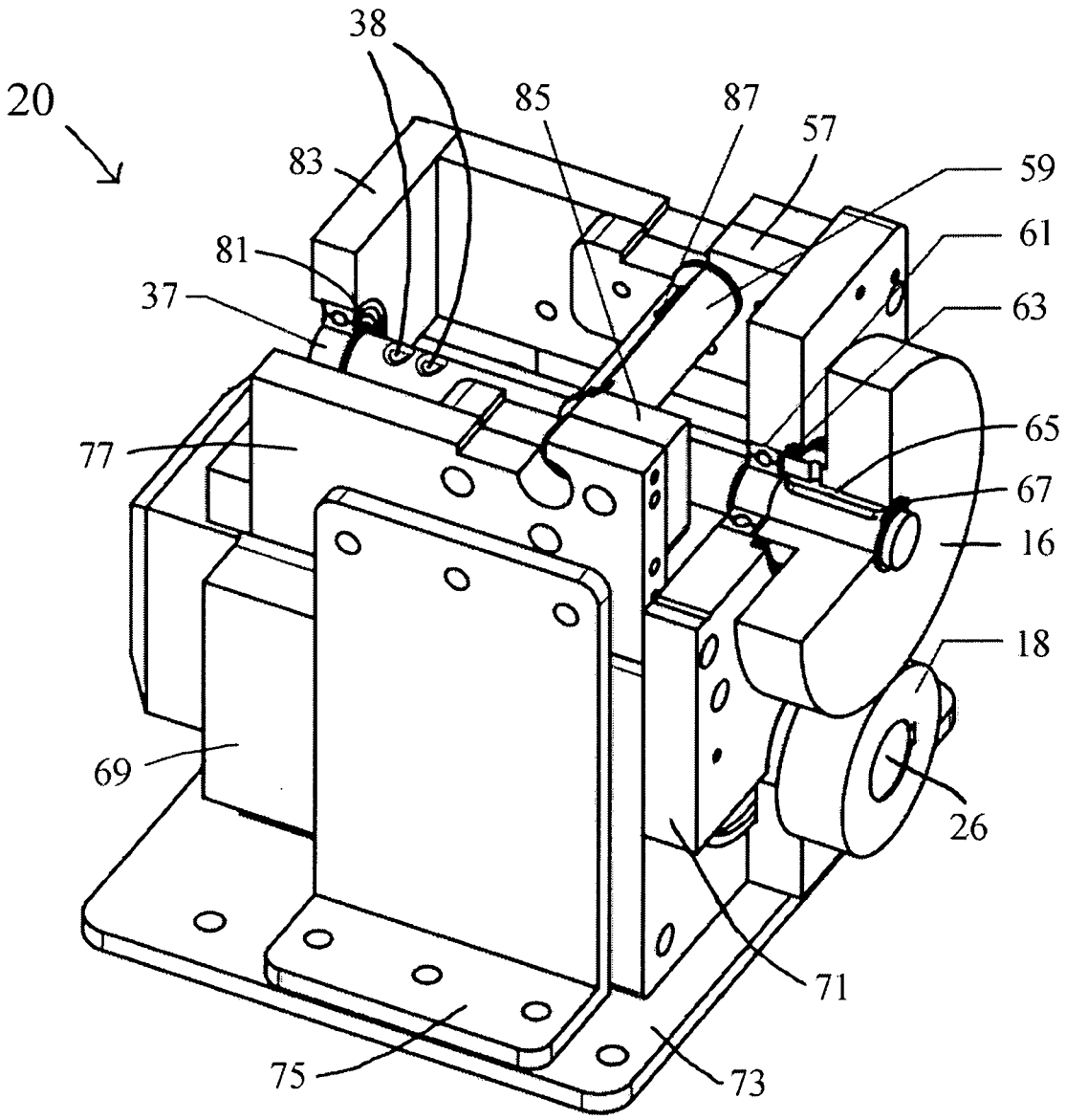
FIG. 5 is a perspective view of a resistance device useful in accordance with some embodiments of the disclosure.

FIG. 5 is a perspective view of a resistance device 20 which comprises a motor 25 and rotatable shaft 37, and which can be thought of essentially as a combination of elements 25 and 17 from FIG. 2. Resistance device 20 includes a motor 69, front flange 71, rear flange 83, base plate 73, right side flange 75, right side plate 77, seeger ring 81, left roller holder 57, right roller holder 85, and roller 59. A roller screw 87 is provided upon which roller 59 is rotably disposed, the roller 59 having a hollow center enabling it to rotate or roll about roller screw 87. One end of roller screw comprises threads, which are screwed into left roller holder 57. Shaft 37 is shown and also shaft key 65 and seeger ring 67. Motor gear 18 is shown disposed at the end of the shaft of motor 69, and shaft gear 16 disposed at the end of rotatable shaft 37 is in meshing contact therewith. Shaft 37 is mounted by means of a shaft bearing such as 61 disposed at or near the ends of shaft 37. An oil seal 63 is provided on each of the rotatable shaft 37 and motor shaft 26, for embodiments when a crankcase is provided to encase or enclose and provide lubrication to gears 16 and 18, by such crankcase containing a pre-determined amount of a liquid or rheological lubricating material, as may be selected to be present. Also shown in FIG. 5 are holes 38, which can be used to thread cable 19 onto shaft 37, however any method of attaching cable 19 to shaft 37 is suitable.

Figure 6:
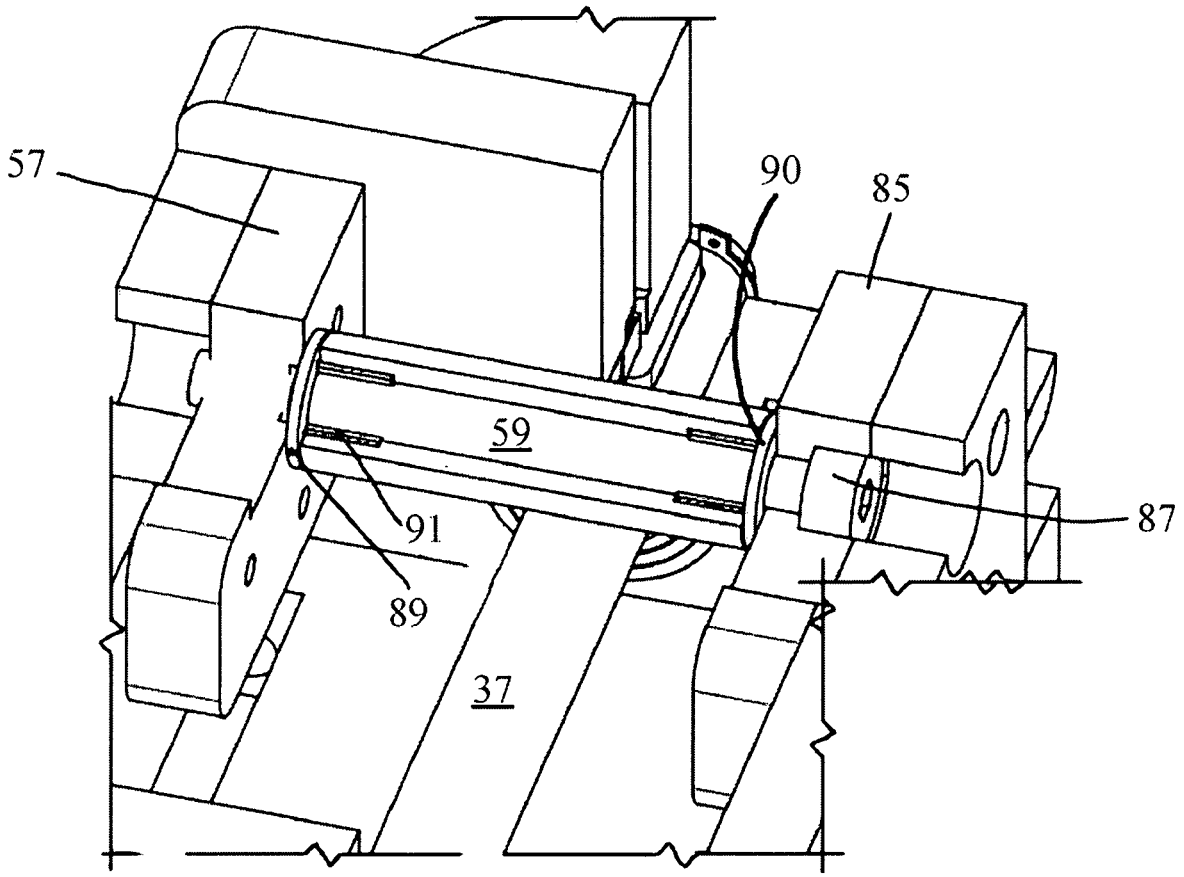
FIG. 6 is a close-up view of a portion of a resistance device useful in accordance with some embodiments of the disclosure.

FIG. 6 is a close up perspective view of a portion of resistance device 20, depicting the respective locations of left roller holder 57, right roller holder 85, roller screw 87, rotatable shaft 37, roller 59, washer 89, washer 90, and needle bearing 91. The purpose of roller 59 is to guide cable 19 onto and off from rotatable shaft 37, for instances when cable 19 is not oriented perfectly perpendicularly to rotatable shaft 37. Such feature allows for resistance device 20 to be mounted to either the right or left of a vertical line dropped down from pulley 21 in FIG. 2 or pulley 43 of FIG. 5, which enables latitude in design of an exercise system or device according to this disclosure.

Figure 7:
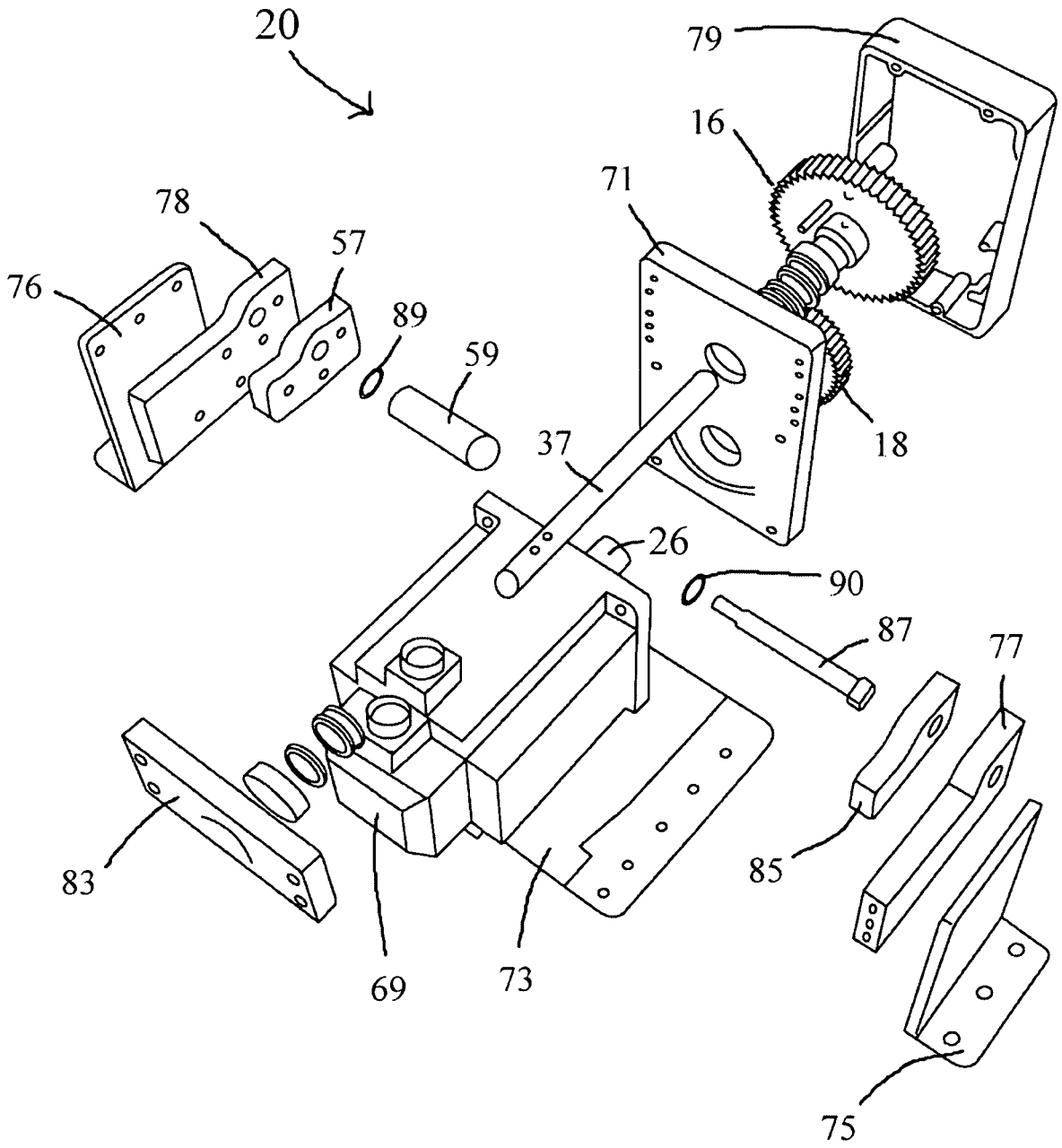
FIG. 7 is an exploded view of the components of a resistance device useful in accordance with some embodiments of the disclosure.

FIG. 7 is an exploded view of resistance device 20 of FIG. 5 depicting the arrangement of its several components including base plate 73, motor 69, rear flange 83, front flange 71, right side flange 75, left side flange 76, right side plate 77, left side plate 78, left roller holder 57, right roller holder 85, roller screw 87, washer 89, washer 90, roller 59, motor shaft 26, rotatable shaft 37, shaft gear 16, motor gear 18, and crankcase 79. Crankcase 79 is configured to sealingly attach to front flange 71 sufficiently to contain a lubricating oil to reduce friction between and wear of gears 16, 18. For this purpose, conventional fasteners are employed.

Figure 8:
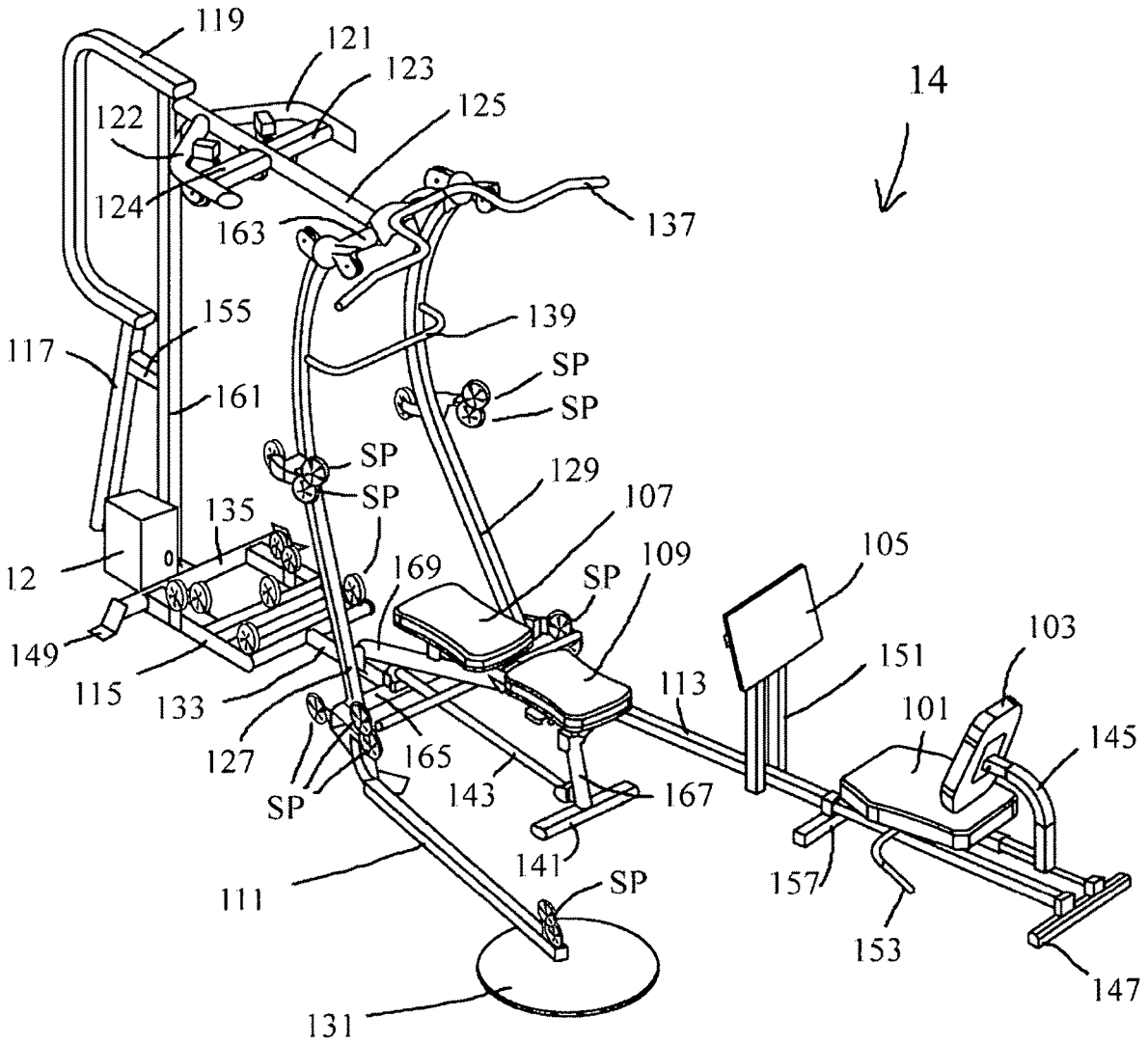
FIG. 8 is a perspective view of an exercise system framework useful in accordance with some embodiments of the disclosure.

FIG. 8 depicts an exercise system framework 14 according to some embodiments, including resistance unit 12 and the same general pulley and cable arrangement that was shown and described with reference to FIG. 4. The framework of FIG. 8 includes a framework having several components connectively attached as shown, using welds or nuts and bolts disposed through adjoining components. There is a first arcuate support 127 and a second arcuate support 129 which generally have some curvature and are somewhat vertically-oriented as shown. These arcuate supports have an upper portion and end disposed towards, at, or near the top of exercise system framework 14 and a lower portion and end disposed towards, at, or near the bottom or ground-level portion of exercise system framework 14. A cross-member 165 is provided which is generally linear but in alternate embodiments could be curved or have a bend in it, the cross-member 165 having a first end attached to first arcuate support 127 and a second end attached to second arcuate support 129, to add stability and rigidity to the framework. In some embodiments a second cross-member (not shown) is employed for additional stability and rigidity, in the proximity of cross-member 165 and attached similarly or exactly as described therefor. Frame rail 111 is provided, being generally linear in construct in some embodiments and in other embodiments having a curved or acruate portion disposed along its length or completely comprising a single continuous curve. The first end of frame rail 111 is attached to the lower portion of arcuate support 127 and the second end of frame rail 111 includes a platform 131, which is made of a rigid material such as a metal, metallic alloy or any selected composite material and in some embodiments is shaped as a disk, that is, circular and having a thickness of any amount in the range of between five millimeters and 30 millimeters, or thicker. Platform 131 provides stability of exercise system framework 14 upon the surface upon which it rests, and can also be stood on by a user when performing an exercise using the resistance access point provided by a cable routed about the stationary pulley SP proximally disposed to the platform 131. There is also a frame rail 113, being generally linear in construction in some embodiments and in other embodiments having a curved or arcuate portion disposed along its length or completely comprising a single continuous curve. The first end of frame rail 113 is attached to the lower portion of arcuate support 129 and the second end of frame rail 113 includes a footing 147, which is made of a rigid material such as a metal, metallic alloy or any selected composite material and in some embodiments can be shaped as a disk, as for platform 131 and can alternately be a linear rod or beam disposed perpendicularly to the length of frame rail 113, as shown.

Present on frame rail 113 along its length and proximal to its second end, is seat 101, which is slidably mounted to frame rail 113. A seat back 103 is provided at one end of a support 145, the other end of which support 145 is slidably attached to frame rail 113. A foot pad 105 is rigidly attached to frame rail 113 by means of vertical support 151, and in some embodiments there are two vertical supports for this purpose. The aforesaid features enable a user to sit on seat 101 with their back up against seat back 103 and feet disposed against foot pad 105, and push with their legs to cause seat 101 and seat back 103 to move away from exercise system framework 14 as a whole. The entire sliding assembly comprising the seat 101 and seat back 103 is effectively attached by means of a cable or the like and a pulley system as previously described to resistance unit 12 thereby providing any pre-programmed amount of resistance force to the user pushing their feet against foot pad 105. A footing 157 is also provided in some embodiments for the same stability purpose as footing 147, and an optional handle 153 can be present essentially attached at any desired location for the user to grip when performing a leg exercise using exercise system framework 14. The seat and seat back are in some embodiments slidably disposed by means of linear bearings along guide rods, and in other embodiments by means of wheels along guide rods. Any sliding mechanism recognized by those skilled in the art suitable for mounting a seat 101 in a sliding arrangement is useful in accordance with the invention.

Attached to cross member 165 are a brace 133 and stabilizer 143 disposed substantially as shown, with their first end portions attached to cross member 165. In some embodiments, along the length of brace 133 is attached a cushion support 169, and at the distal or second end of stabilizer 143 is also a cushion support 167 which extends generally upwards from the surface upon which exercise system framework 14 rests. A footing 141 is provided substantially in the location shown, for the same purpose as footings 147, 157. Cushion 107 is thus attached to and rests upon cushion support 169 substantially as shown and cushion 109 is thus attached to and rests upon, in varying embodiments, either or both of cushion support 169 and cushion support 167. These cushions 107, 109 enable a person to lie flat on their back across these cushions, and access resistance access points provided at stationary pulleys SP disposed along the lengths of, and at the upper portions of arcuate supports 127, 129. A handle 139 is provided as shown, attached to each of arcuate supports 127, 129 which can be grasped by a user for convenience and also adds rigidity to the system as a whole.

At the upper ends of arcuate supports 127, 129 is a support 163 having a first end attached to arcuate support 127 and a second end attached to arcuate support 129. In some embodiments a chin bar 137 is attached to support 163 to enable a user to perform chin-up exercises.

A forward support member 125 having a first end and a second end is attached at its first end to support 163, and is attached at its second end to the upper portion of a vertical support 161. Vertical support 161 is generally linear and has a lower end also, which extends substantially to the surface upon which exercise system framework 14 rests. Resistance unit 12 is present substantially at the lower portion of vertical support 161, and there is also attached at the lower portion of vertical support 161 a substantially rectangular framework comprising pulley support 115 and brace 135. Each of pulley support 115 and brace 135 have counterparts on opposite sides of the substantially rectangular construct of which they are a part, in some embodiments, and the substantially rectangular construct or framework is a location at which a plurality of stationary pulleys SP are rigidly attached. This construct is also attached to brace 133, as shown. Although described as being substantially rectangular or rectangular, the construct to which the subject stationary pulleys SP are attached can be of other shapes such as circular or any selected shape, with the main proviso being that it be attached at the lower end of vertical support 161 and brace 133 or an analogous element to brace 133 in the particular construct selected. The person of ordinary skill in this art immediately recognizes after reading this specification that slightly modified structures which achieve the same function as herein described are inherently within the scope of this disclosure. This includes making the substantially rectangular construct comprising pulley support 115 and brace 135 to be circular in appearance and only comprising a single circular piece of steel or the like, having tangs welded thereto for the purpose of attaching stationary pulleys SP thereto and providing the functions taught herein. Or, alternately constructing exercise system framework 14 from tubular stock that is circular in cross section versus square in cross section. Any of such modifications do not deviate from the scope of the present disclosure and the claims written having support in this specification inasmuch as such modifications provide an exercise system having the same function and synergies inherent or specifically recited.

The construct which comprises pulley support 115 and brace 135 can have one or more than one footings 149 to provide additional support to exercise system framework 14 as a whole. Moreover, for added stability and aesthetic design purposes, there can be provided a vertical frame support 117 attached to vertical support 161 either directly or by means of an optional support member 155. In some embodiments there is also provided a vertical frame member 119 which can be C-shaped with its upper end attached to the upper end of vertical support 161 and its lower end attached to the upper portion of vertical frame support 117, substantially as shown.

In addition, present along forward support member 125 is another construct which serves to be a sub-framework for support or attachment thereto of a plurality of stationary pulleys SP (FIG. 10) which serve to enable the functions herein disclosed. In the non-limiting exemplary embodiment of FIG. 8, there are depicted pulley support 121, cross member 123, pulley support 122 and cross member 124. As with other elements described herein, these elements can be discrete elements as shown, or can be of a singular construct and be of different shape as a whole, provided the function is the same and the attachment is substantially the same or substantially similar sufficiently to enable the functions and synergies inherent or specifically recited herein.

Figure 9A:
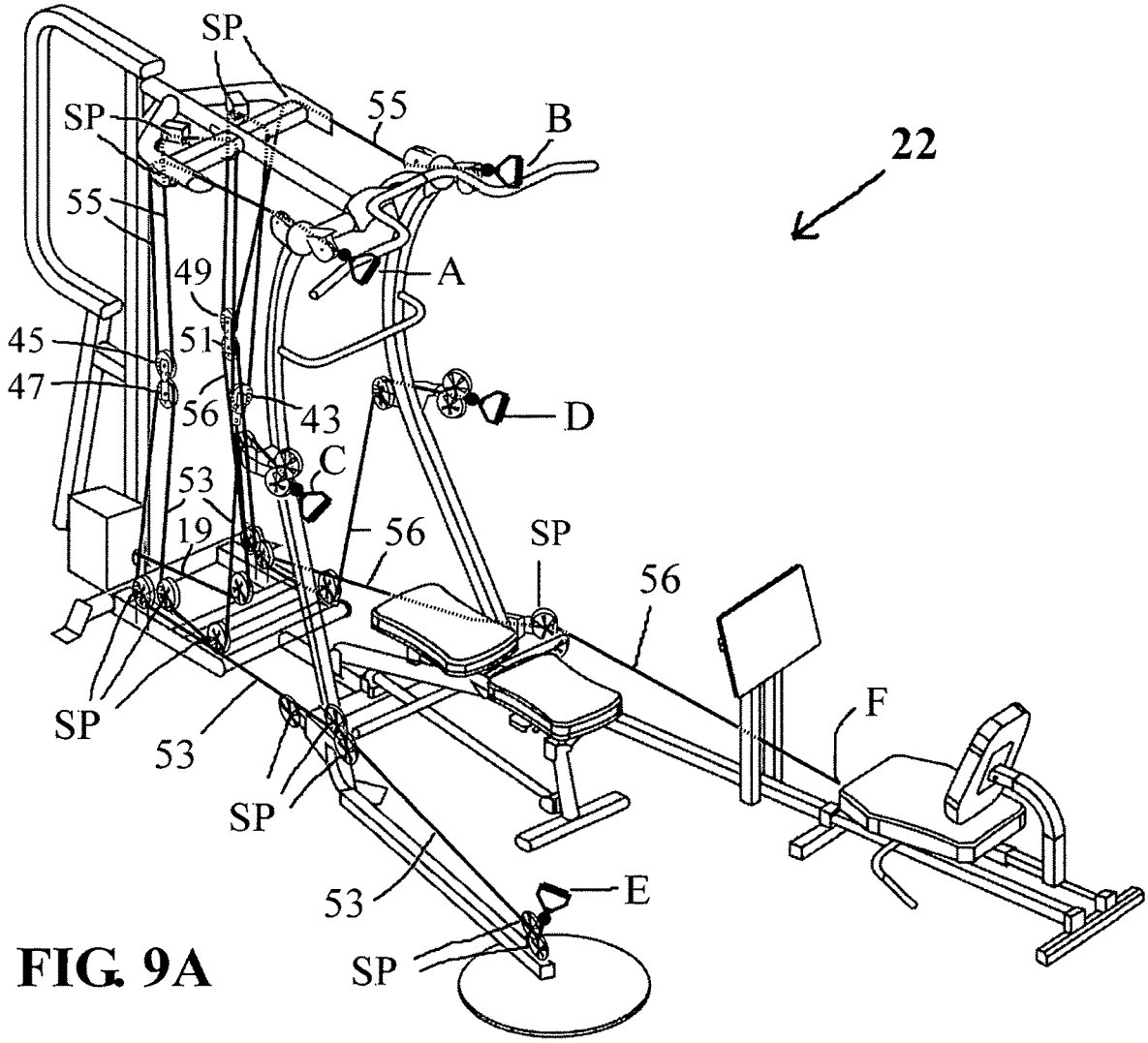
FIG. 9A is a perspective view of an exercise system framework useful in accordance with some embodiments of the disclosure, further including a plurality of cables useful therewith.

FIG. 9A illustrates an exercise system 22 which embodies the exercise system framework 14 shown and described with reference to FIG. 8, further including a plurality of cables useful therewith, in their positions in the assembled device. In this FIG. 9A, the various cables are highlighted, and for clarity these features are depicted stand-alone in FIG. 9B.

Figure 9B:
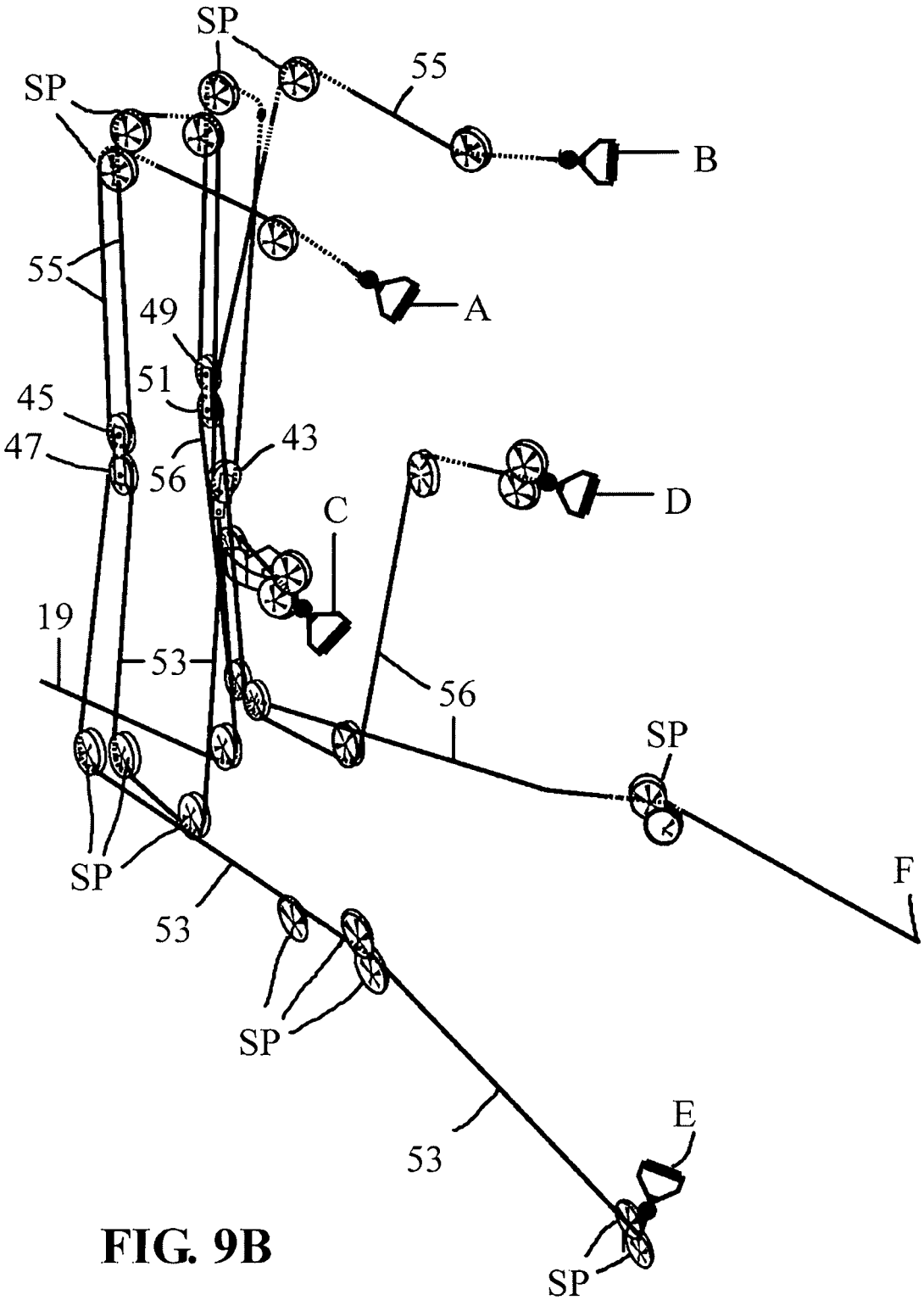
FIG. 9B is a perspective view of a pulley and cable network useful in accordance with some embodiments of the disclosure, wherein the framework from FIGS. 8 and 9A have been omitted for clarity.
Figure 22:
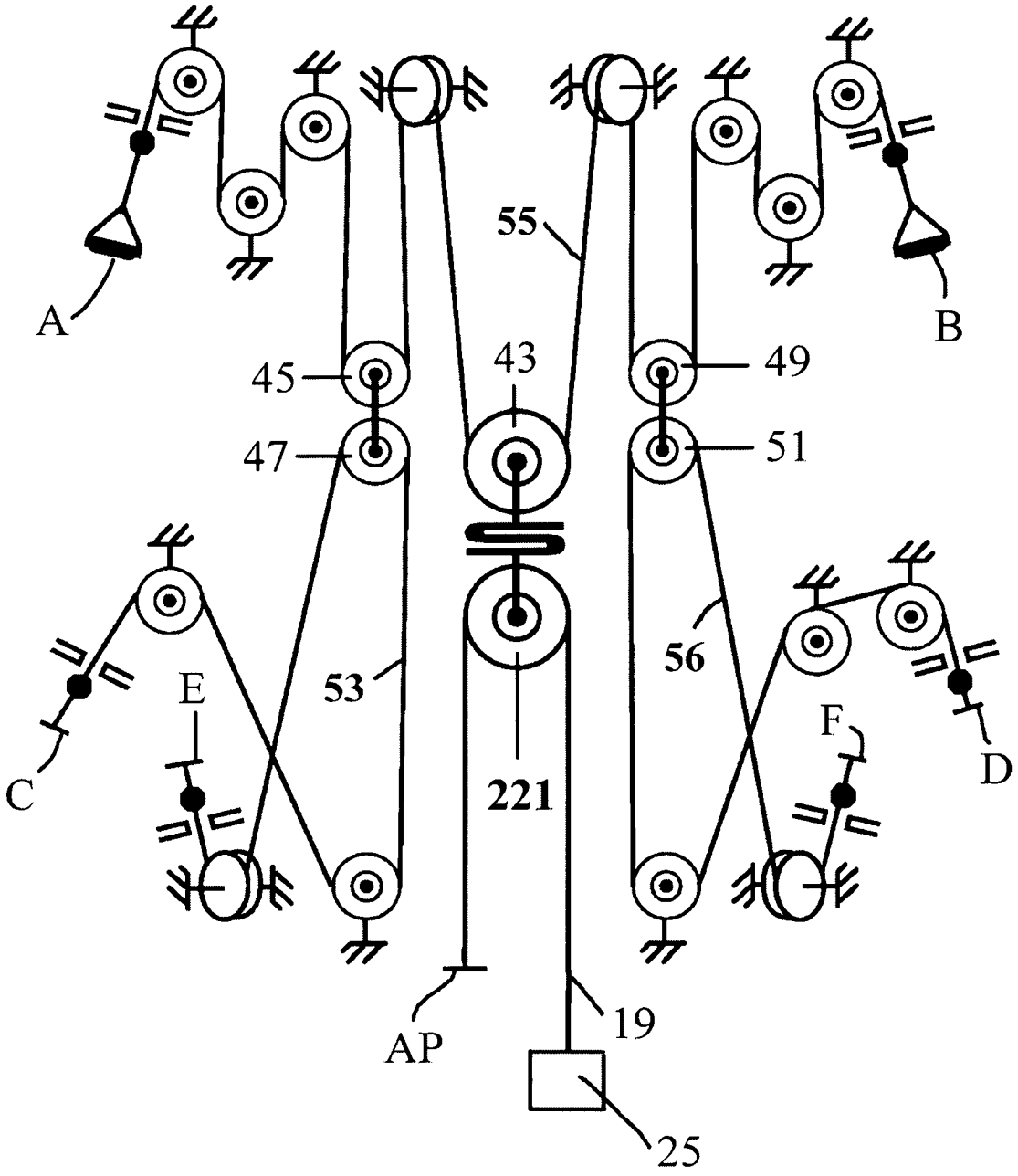
FIG. 22 is a schematic representation of a cable and pulley network useful in providing an exercise system in accordance with some embodiments of the disclosure, including the embodiment shown in FIG. 20.
Figure 23:
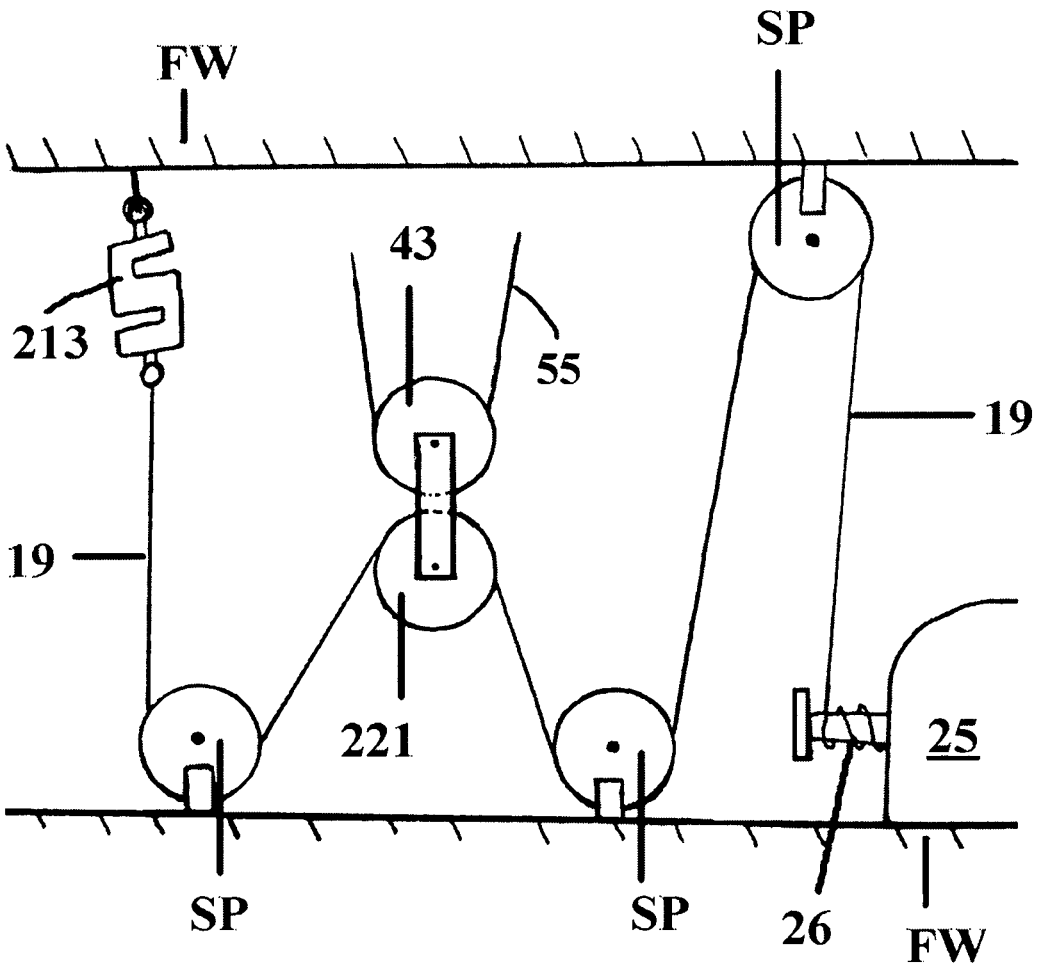
FIG. 23 is a schematic representation of a cable and pulley network useful in providing extra advantage to an exercise system in accordance with some embodiments.

FIG. 9B shows a pulley and cable network 4 and illustrates the arrangement of various cables and pulleys in their general shape, form, and orientation when present on an exercise system framework 14 as shown and described with reference to FIGS. 8 and 9A. In the lower left portion of FIG. 9B, cable 53 is seen to span several stationary pulleys SP and is routed about mobile pulley 47, across a couple of stationary pulleys SP and back upwards over another stationary pulley and between two more stationary pulleys, to provide resistance access point C, at the opposite end of cable 53 from resistance access point E, as previously described and depicted schematically in FIG. 4. Although these embodiments may employ the configuration shown and described with reference to FIG. 4, the pulley rigs shown and described later with reference to FIGS. 22 and 23 are also suitably employed with framework 14.

Similarly, cable 56 terminates at one end at resistance access point F, which is attached to the slidably mounted seat 101 to provide resistive force thereto. The opposite end of cable 56 is seen to be similarly routed, as also schematically represented and described previously with reference to FIG. 4 and terminates at resistance access point D. Thus, resistance access points C, D are accessible to a user sitting or laying on cushions 107, 109 (FIG. 8), as these resistance access points are provided approximately midway along the lengths of arcuate supports 127, 129 (FIG. 8).

Similarly, cable 55 terminates at one end at resistance access point A, and is routed over the stationary pulleys shown and about mobile pulleys 45, 49 and terminates at resistance access point B. Resistance access points A and B are accessible a the upper portions of arcuate supports 127, 129 (FIG. 8).

Figure 10:
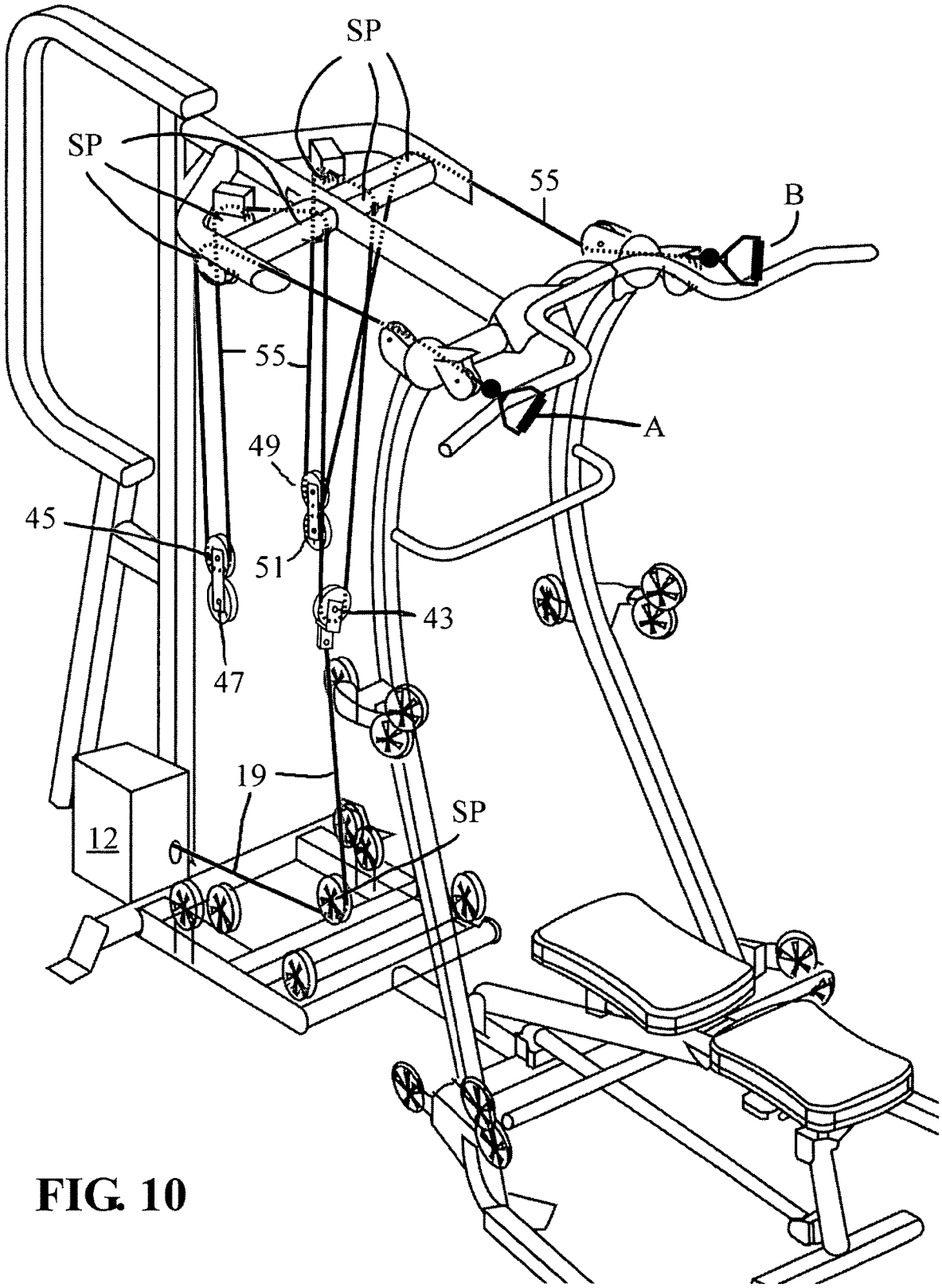
FIG. 10 is a close up perspective view of a sub-portion of a system provide by and useful in accordance with some embodiments of the disclosure.

FIG. 10 is provided to show with further clarity the routing of cable 19 from resistance unit 12, about a stationary pulley SP attached centrally on the construct which comprises pulley support 115 (FIG. 8) and terminating at its attachment to mobile pulley 43. The routing of cable 55 is also more clearly depicted in this close-up perspective view.

Figure 11:
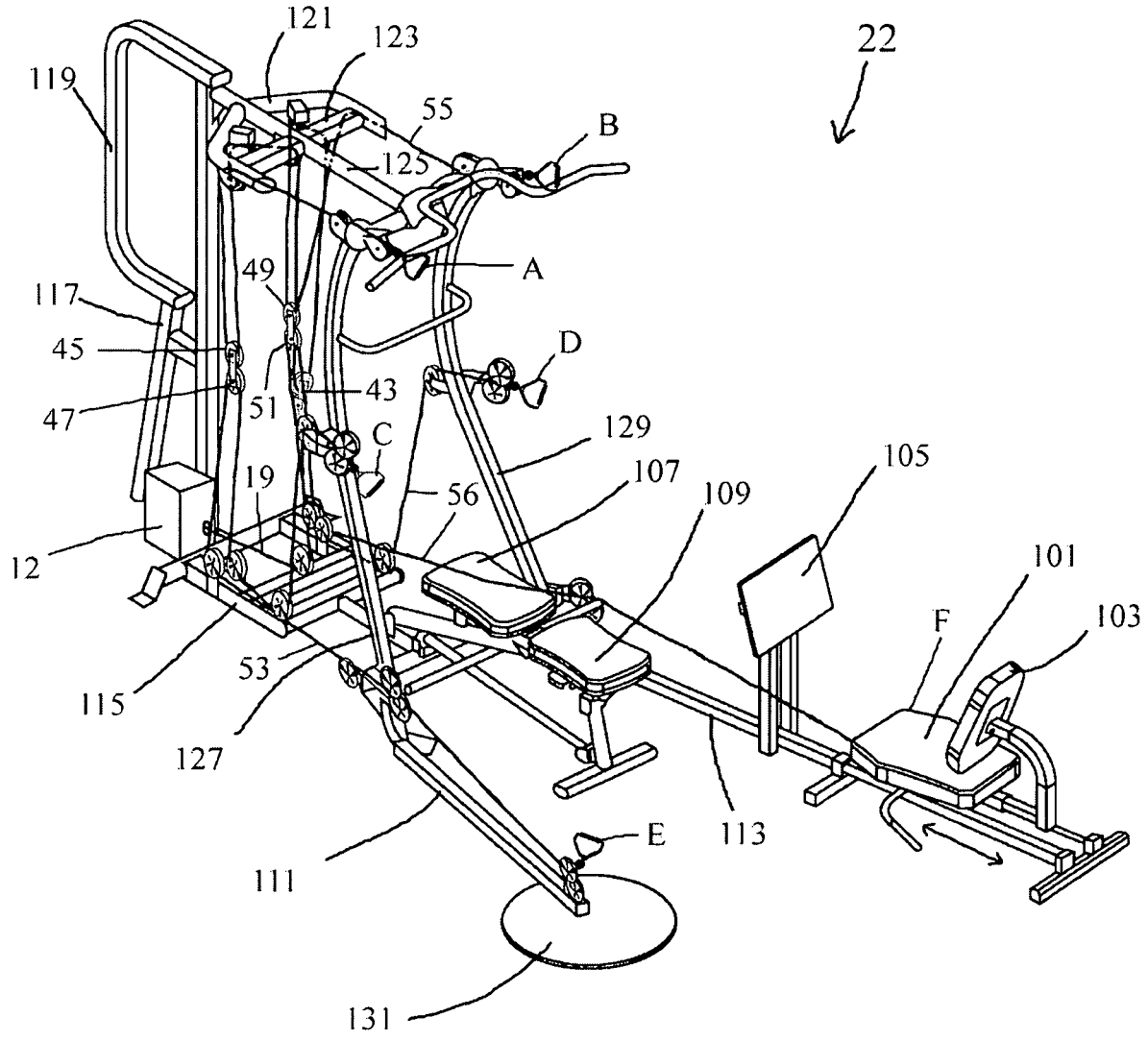
FIG. 11 is a perspective view of an exercise system provided by and useful in accordance with some embodiments of the disclosure.

FIG. 11 shows an exercise system 22 according to some embodiments of the invention and is the same perspective view of the exercise system framework 14 previously shown and described with reference to FIG. 8, but in this view the cable and pulley network 4 from FIG. 9B is also shown present on the system as a whole. Exercise system 22 is a complete device according to some embodiments of this disclosure and is suitable for a person to perform exercise of many different bodily muscle systems. System 22 has no weight stack, and all resistive force is provided by resistance unit 12 which itself is in some embodiments remotely controlled by wireless communication using a motor controller 27 and/or a remote controller unit 41.

The computer-controlled resistance unit 12 as provided herein can be substituted in the place of a weight stack of any exercise equipment frame design having a system of cables and pulleys or guide bars, including those for which the direction of motion of the weight stack is limited to a single direction. Existing exercise equipment so retrofitted becomes capable of exercise modalities described herein and previously unattainable by such equipment. Use of the computer-controlled resistance unit 12 provided herein replaces the fixed force curve previously associated with the use of a weight stack, with new force curves that are selectively customizable by a user for targeting specific training outcomes. This includes providing purely isokinetic exercise modalities and elimination of safety considerations associated with isoinertial exercises.

Advantages Over Prior Art

One advantage conferred by the present disclosure is that systems provided herein enable loading the muscles of the user with more force during the eccentric phase of exercise motion than is provided during the concentric phase of exercise motion.

Another advantage of a system of the current technology over the prior art relates to the fact that in prior art exercise equipment, the use of cables, pulleys, and weights often dampens the effect of the weight stack such that the values are not accurate, i.e., 50 kilograms on the weight stack often does not behave as if the person were actually lifting 50 kilograms. In the instant technology on the other hand, due to the presence and use of torque sensor 211 and load cell 213 (FIG. 12), the values read therefrom are transformed into accurate representations of the force being applied by motor 25 to resist the force applied by a user. In response thereto, the force values calculated by microprocessor 97 and commanded to motor 25 during an exercise by a user take into account the nature of the exercise selected by the user, by calculating the necessary force multiple, while accounting for pulley configuration, angle of incidence while using proper form and the dampening effect of the pulleys in the system. This multiple is represented as a floating point value, generally within the range $0.5 \leq x \leq 2$, although when using different configurations of a frame 35 having differing pulley configurations, values outside this range may be found suitable. For example, when a user elects to perform a Tricep Press, some systems have a configuration which effects a 0.5× multiple upon load cell 213. During isokinetic/isometric exercises, interpreted values are reporting after application of this multiplier such that the feedback provided visually to the user reflects the force felt by the user. During isotonic type exercises, the torque commanded to the motor is adjusted by this multiplier such that the force the user feels on the given handle or resistance access point accurately reflects the requested target.

In the pulley arrangement herein described, in some embodiments when only one side of an exercise system such as system 22 is used for an exercise, a mechanical advantage in favor of the user is provided. In a conventional weight-stack exercise device, a 50 kg load would behave as only 25 kg when only one side of the device is being used for an exercise. Using the instant technology, the user is presented with the actual force value they are physically sensing, which in some embodiments is automatically adjusted by microprocessor 97. When a user opts to perform a selected exercise, they indicate the exercise of their choice as a data entry and the system software identifies whether the selected exercise utilizes one handle or two. When the user performs an exercise that uses a single handle (resistance access point) the advantage to the user is 2:1, whereas when a user performs an exercise with two handles, the advantage is 1:1, i.e., no advantage. The force recorded and reported to the user is accordingly adjusted. According to use of a device and methods of this disclosure, an accurate representation and logging of all work performed is obtained, regardless of wear on the machine or the elongation of any cables present, friction of pulleys, etc.

System Features

The present technology also includes the ability to perform networked behavior, for example, a "tug of war" between two users or teams of users on different machines located in remote locations from one another.

Moreover, user-specific resistance curves are attainable by use of devices and methods of this disclosure on essentially any exercise equipment, including exercise equipment equipped with pin-stack weight loads. Existing weight stack systems often utilize either a direct pull (a single cable attached to the weight stack) or a pulley driven (a pulley atop the weight stack) approach. In either case, with the weight plates removed, the cable coming off the motor shaft may be affixed to the point of connection between the exercise equipment and its original weight stack. This is generally accomplished by means of hardware store connectors (an eye bolt, for example). At the base of the exercise equipment, directly underneath the weight stack, a pulley must be affixed, whether by bolting or other permanent means, in order to direct the force of the cabling up into the weight stack. In this manner, the weight stack of an existing machine is effectively being provided by the motor instead.

Another difference between the current technology and prior art computer controlled exercise equipment is that the prior art devices and systems limit the user's ability to use the multiple exercise attachment points; for example, prior art devices require the user to be seated. Prior art systems which feature a plurality of modalities do not switch between the different modes offered, whereas in the current technology a seamless transition between isokinetic and isometric is provided, which permits a user to perform a "flex and hold" exercise. The speed of the concentric/eccentric speed of the motor may in some embodiments be adjusted during the course of an exercise. During such an exercise, if the speed of the current motion is reduced to zero, the motor is commanded to stop thereby allowing any cable to be released, resulting in an effective transition between isokinetic and isometric modalities.

As one beneficial output, systems according to some embodiments provide users with highly detailed information regarding the results of their exercise. Such information includes maximal force exerted in both concentric and eccentric phases of exercise, total work done, average force over time exerted in both concentric and eccentric phases of exercise, a breakdown of total force exerted during an exercise on a per-repetition basis. Load cell data is polled by the software on a periodic basis. Generally, this polling occurs every 100 ms (the firmware/motor can in some embodiments be made to track the load cell data far more frequently for safety reasons). This data is collected from the time the exercise starts until the user indicates that the exercise has stopped. It is moreover determined, whether the motor is releasing cable (indicating concentric motion) or retrieving cable (indicating eccentric motion). The maximal force is the maximum value observed during a particular direction of motion, observed over all repetitions. That is, for all load cell observations wherein the motor is retrieving cable over the course of an exercise, the highest value is deemed to be the maximal eccentric force. The average force is the arithmetic mean of all load cell observations during a particular direction of motion, observed over all repetitions. That is, for all load cell observations wherein the motor is releasing cable over the course of an exercise, the sum of all observations divided by the number of observations is the average force. The average force is also examined on a per repetition basis for a given selected exercise. In that case, it is the arithmetic mean of all load cell observations during a particular direction of motion, from when that direction of motion starts until we reverse direction again. For example, during an arbitrarily selected Repetition #4, we switch from eccentric (at the end of a prior Repetition #3) to concentric. The load cell observations are all summed until the user has reached their maximum range of motion, at which point the motor reverses and begins the eccentric motion for Repetition #4. The average concentric force for such a Repetition #4 is that sum, divided by the number of observations during that time. Work is defined as Force*displacement. However, in many embodiments the load is dynamic. The load cell polling frequency is used in the calculation to provide a high precision estimate of the total work. The load cell reading is known on a regular interval (100 ms in some embodiments) and in some embodiments the load is considered as being effectively constant over that 100 ms interval. The current speed of the motor is also known for particularly selected points in time and the work calculation for a given 100 ms interval is then provided by (CurrentForce)*(0.1 s)*(Motor Speed). A sum can be taken of these values over the entirety of a particular exercise to provide a value for Total Work, expressed in Joules.

System Description

Figure 12:
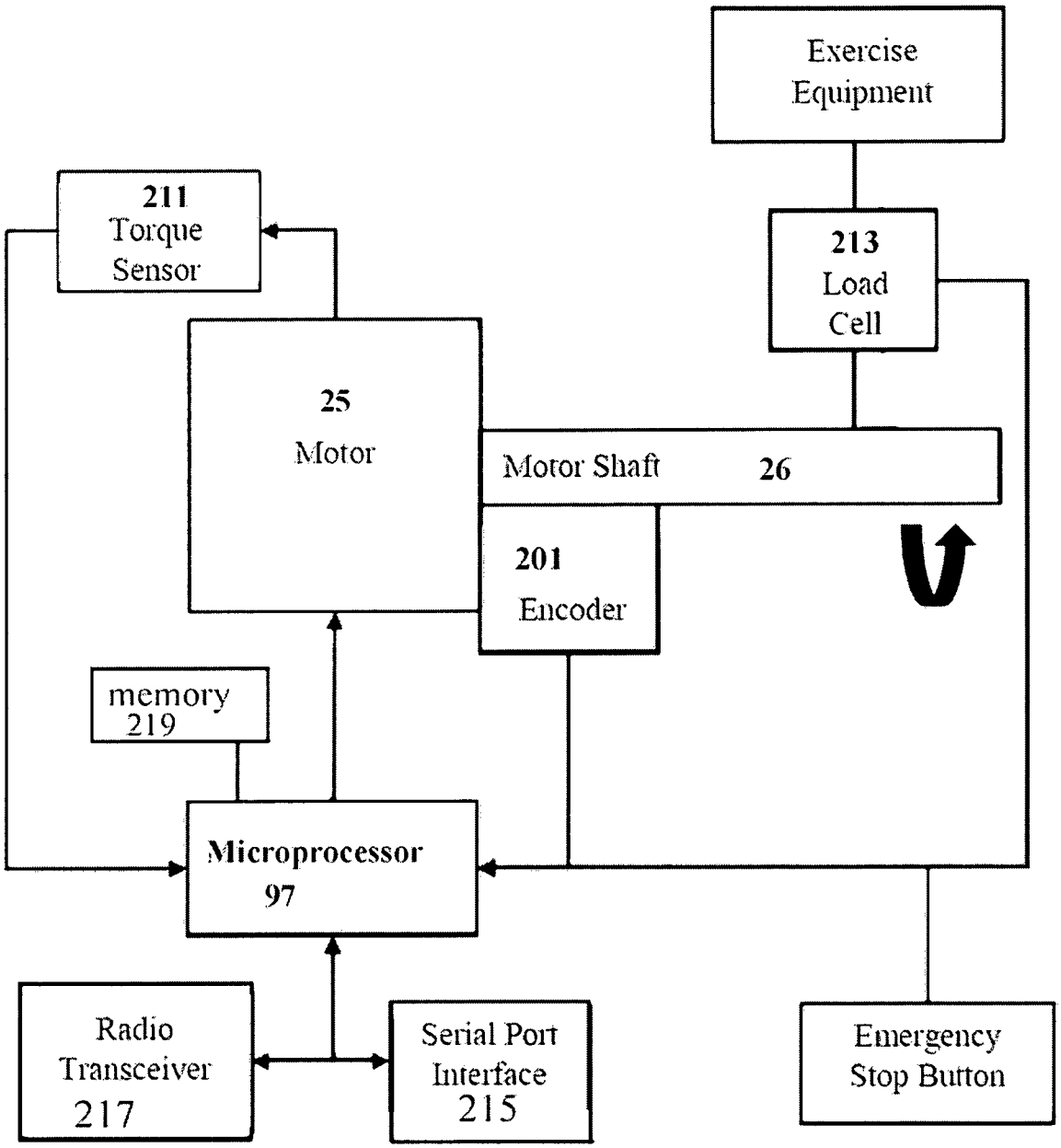
FIG. 12 is a schematic representation of various components useful for controlling a system according to some embodiments of the disclosure.

Referring to FIG. 12, there is shown a block diagram of components present in some embodiments of a system of the disclosure. Motor 25 is driven in some embodiments using a constant voltage power supply mode, thereby producing a constant speed of rotation of motor shaft 26, with variable torque output. In other embodiments, the power supply is made to operate in a constant current (amperage) mode, thereby providing a constant torque output at shaft 26, with a varying speeds of rotation. Also shown in FIG. 12 is encoder 201, which can be any encoder capable of tracking the physical position of motor shaft 26 and outputting a signal which increments as shaft 26 rotates, which signal is used as an input to microprocessor 97 and provides a determination of how many times shaft 26 has rotated within any pre-selected or specified time interval. Total positional displacement of cable 19 is determined based on the diameter of shaft 26 and the number of rotations it has made, for any selected point in time. Towards this end, cable 19 can be essentially any highly flexible cable with a high breaking strength and low elongation. In some embodiments a UHMWPE rope is employed (such as are available under brand names DYNEEMA™ or SPECTRA™). At breaking load, these show an elongation of 3%-5%. In some embodiments, cable 19 is selected to be comprised of braided stainless steel.

There is also a torque sensor 211, which in some embodiments is integrated into the circuitry of the control board of, or the output of which is otherwise provided as an input to microprocessor 97. In some embodiments, torque sensor 211 uses the back-EMF characteristics of motor 25, when providing an output that is convertible into a torque value, as is known in the electrical arts. Torque sensor 211 operates in some embodiments using an EMF signal that varies in proportion to the resistance experienced by motor 25. In some alternate embodiments, a true load cell is employed.

In some embodiments, a load cell 213 of the S-type or any other suitable known type of load cell capable of detecting both compressive and expansive forces, and is connected in-line between cable 19 and the pulley assembly. In some embodiments, load cell 213 is tied in place, allowing it to hang freely, which provides advantage over alternate arrangements which render it to be subject to transverse forces which can affect the accuracy of its output, which is provided to microprocessor 97 as an input. This results in increased accuracy in determining the torque output of motor shaft 26. The load cell output signal is used as an input to microprocessor 97 for the purpose of adjusting the voltage or current to motor 25, towards maintaining the torque output of motor 25 at any pre-selected, desired, or calculated level as a function of time. In some embodiments the torque of motor 25 is dependent on the position of the user's limb in the calibrated range of motion during an exercise. Load cells capable of detecting up to about 1500 pounds of force are suitable for use herein.

Modalities

In addition to isokinetic and isoinertial exercise modalities, exercise equipment fitted with resistance unit 12, and a microprocessor-based system provided herein that is configured to carry out the various functions described herein additionally enables isotonic and isometric modalities. Newly-created modalities are also possible, which can selectively include any one or more than one of the four modalities above independently combined with one another to create a hybrid modality.

Figure 13:
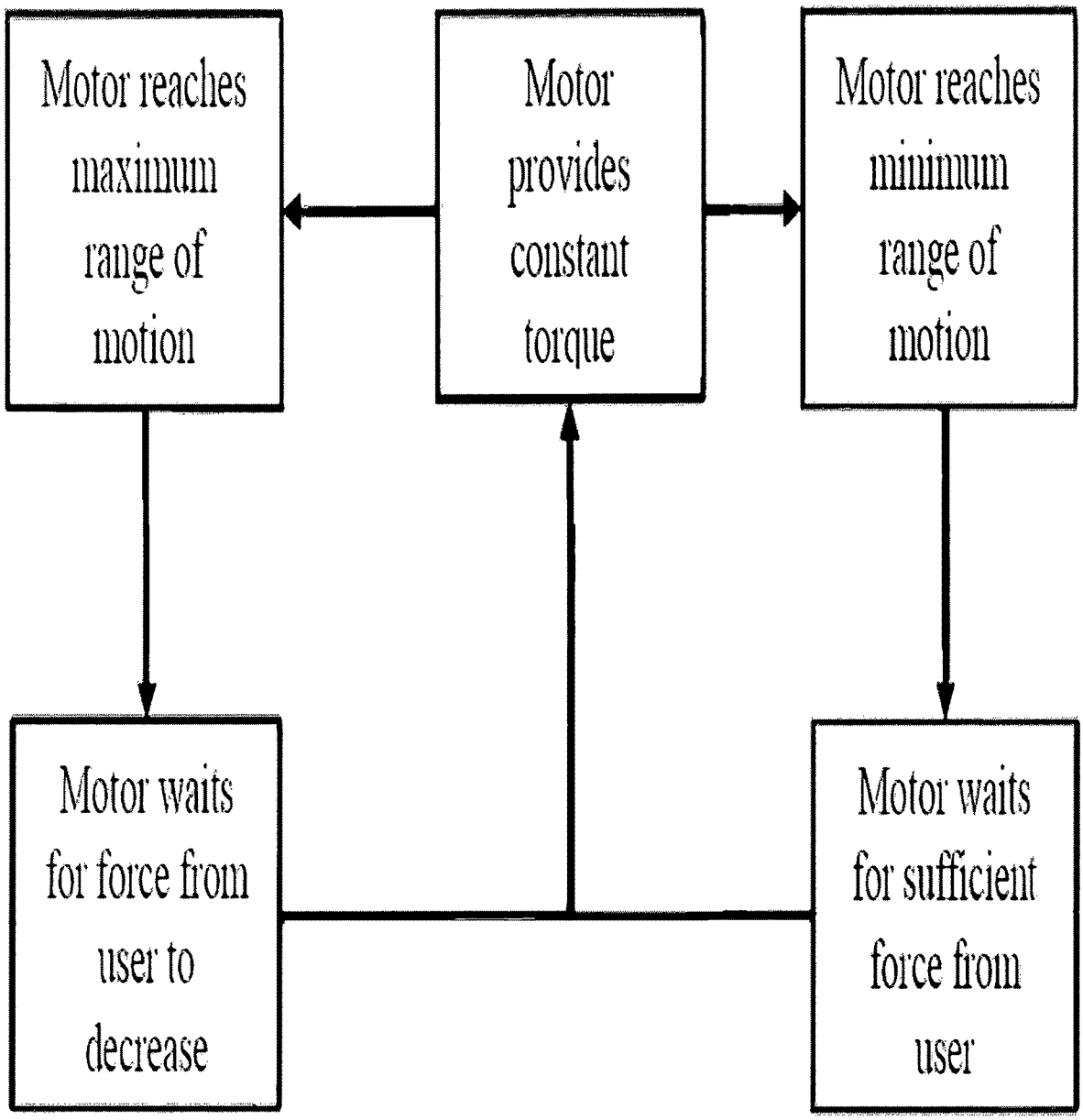
FIG. 13 is a schematic representation of events associated with an isotonic mode of exercise according to some embodiments of the disclosure.

One of the exercise modalities enabled by this disclosure is the Isotonic mode, which is characterized as exerting a force against a pre-determined mass being acted on by gravity. The isotonic mode is analogous to exercise equipment which employs a common weight stack as the source of resistive force to motion. In some embodiments, microprocessor 97 is programmed in this mode such that if the user provides more force than provided by the shaft 26 of motor 25, then motor 25 permits shaft 37 to rotate sufficiently to release or let out cable 19 up until the maximum point of the pre-calibrated range of motion for the particular exercise selected is achieved. In some embodiments, for the isotonic mode, microprocessor 97 is programmed such that if the user is providing less force than motor 25 at any point in the exercise, motor 25 will cause shaft 37 to rotate sufficiently to take up cable 19 up until as far as the minimum point of the pre-calibrated range of motion for the particular selected exercise. In some embodiments of this mode, for the hypothetical situation where the user were to release a grasping handle, or other physical article such as a bench press bar present at a resistance access point at any point in time during the exercise, the lack of the users applied resistance or force is detected and microprocessor 97 is programmed to cut off power to motor 25 responsively to the sudden cessation of applied force or resistance by the user. This is schematically illustrated in FIG. 13.

An isotonic exercise conducted using the instant technology need not abide by the standard concentric/eccentric repetition, as it is mimicking a traditional weight stack. To that end, its safety considerations are slightly different than other modes. While the system is programmed so that motor 25 will stop once the minimal range of motion is reached, the simple release of the handle will result in the acceleration of the handle towards the machine. In light of this, an additional safety constraint is programmed to microprocessor 97 which precludes isotonic exercises from being performed at cable movement speeds which would occur when a grasping handle were to be suddenly released. Thus, in addition to the range of motion limitation, if a user releases the handle, the rapid acceleration of cable 19 is sensed by the system and the microprocessor interprets this as meaning that no user is providing any resistance. In such scenario the system terminates the exercise prematurely by stopping motor 25.

Another of the exercise modalities enabled by the instant technology is termed the Differential Isotonic mode, which is characterized by microprocessor 97 commanding motor 25 to provide a first constant or fixed amount of torque during the concentric phase of a given exercise, and a second amount of torque that is different from the first fixed amount of torque during the eccentric phase of the same exercise. A simplified representation of this Differential Isotonic mode is a situation in which a weight stack is being used in a conventional exercise system, and weight is manually added or removed by a second person at the end of the concentric phase of exercise. This enables a user to concentrate their mental and physical energy during a sub-portion of an exercise. The determination of whether motion is in the eccentric or concentric phase is based upon the achievement of one or the other end of the predefined range of motion. When the cable is permitted to retract to the minimum range of motion, the system interprets the total cable displacement as an indication that eccentric motion has ended, and concentric motion is beginning. Similarly, when the user pulls enough cable out such that they reach their predefined maximum range of motion, the system interprets the total cable displacement as an indication that concentric motion has ended, and eccentric motion should begin.

In some embodiments of Differential Isotonic mode, the second amount of torque that is different from the first fixed amount of torque is a constant torque. In other embodiments the second amount of torque that is different from the first fixed amount of torque is a torque that varies over time throughout the eccentric phase. In some embodiments, the torque increases constantly or according to any pre-selected function throughout the eccentric phase, and in other embodiments it decreases constantly or according to any pre-selected function throughout the eccentric phase. In some embodiments, when the torque in the eccentric phase is variable, microprocessor 97 commands motor 25 to provide the second amount of torque to be any amount or torque either greater or less than the first fixed amount of torque.

In some embodiments, when transitioning between concentric and eccentric phases in Differential Isotonic mode, the speed of motor 25 is controlled directly by microprocessor 97 without being adjusted or modified based on any sensor input data. For such embodiments, the speed of motor 25 is controlled entirely by software commands preprogrammed in memory 219 or otherwise fed to microprocessor 97. Concentric motion, while medically the action of shortening a muscle, is defined in microprocessor 97 as motion which unwinds cable from the motor, which generally aligns with activities which are actually concentric in nature. When the user reaches their maximal range of motion or, in the case of isotonic modalities, the system causes the torque output of motor 25 to reverse direction, and eccentric mode is thus entered. At the opposite end, when the user reaches their minimal range of motion, the system causes concentric mode to be entered.

Figure 14:
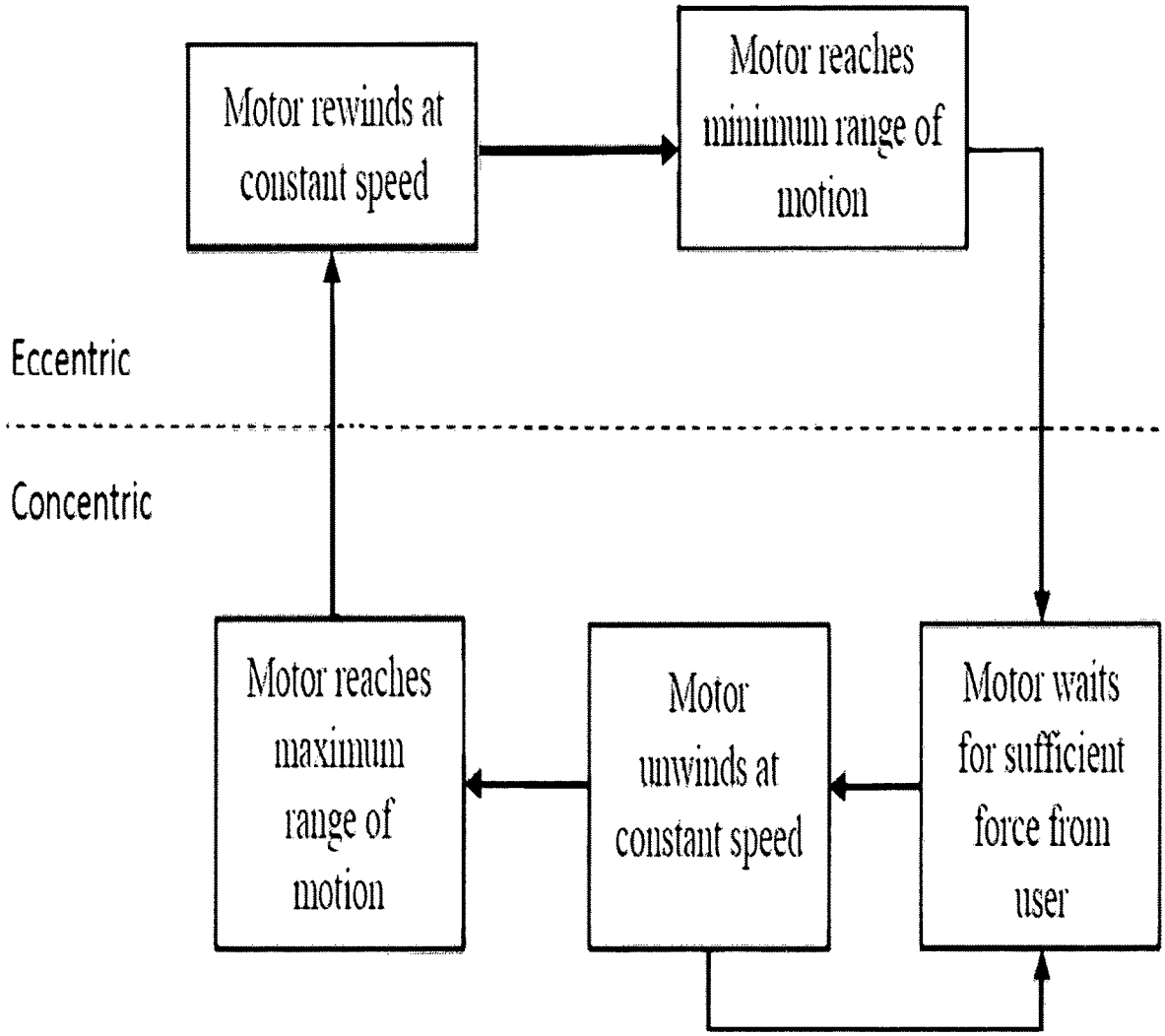
FIG. 14 is a schematic representation of events associated with an isokinetic mode of exercise according to some embodiments of the disclosure.

Another of the exercise modalities enabled by the instant technology is termed the Isokinetic mode. The Isokinetic mode is characterized by a constant speed of cable 19 winding or unwinding onto or from shaft 37 throughout the range of motion of a given exercise, through both the concentric and eccentric phases. Thus, the user is performing a movement of their body part being exercised, at a pre-selected rate or speed. With reference to FIG. 14, during the eccentric phase of an isokinetic exercise, motor 25 is commanded to wind cable 19 onto shaft 37 at a constant speed until the minimum point in the range of motion of the user's body part for that particular exercise as previously established during the range of motion determination has been reached. Once the range of motion having reached its minimum point has been detected or determined by the microprocessor using the established range of motion as an input, motor 25 is then commanded to reverse rotation of shaft 26, subject to the proviso that motor 25 only operates in the reverse direction so long as a force exerted on cable 19 by the user is detected by either one or both of torque sensor 211 and load cell 213. Such feature ensures and maintains orderly winding of cable 19 on shaft 37. In some embodiments, after motor 25 is caused to reverse direction in this mode, motor 25 is commanded to operate at a constant speed of rotation. Once the maximum point of the previously-determined range of motion has been achieved, motor 25 is commanded to again change its direction of rotation, and the isokinetic exercise modality repeats for as many repetitions desired by the user. The system determines when maxima and minima are reached during Isokinetic mode exclusively by the displacement of the cable, and a change between eccentric and concentric phases will not occur without the user at least reaching the transition point between eccentric and concentric phases.

Another of the exercise modalities enabled by the instant technology is termed the Differential Isokinetic mode. The Differential Isokinetic mode is characterized by a constant speed of cable 19 winding onto, or unwinding from shaft 37 throughout both the concentric and eccentric phases of motion of a given exercise. The constant speed throughout the concentric phase can be selected to be either greater or less than the constant speed throughout the eccentric phase or range of motion. When transitioning between concentric and eccentric phases in this mode, the speed of motor 25 is controlled directly by microprocessor 97 without being adjusted based on any sensor input data. The speed of motor 25 is controlled entirely by software commands pre-programmed in memory 219 or otherwise fed to microprocessor 97.

Another of the exercise modalities enabled by this disclosure is termed the Isometric mode, which is characterized by locking shaft 37 in place in order that cable 19 cannot move, thereby providing an exercise ability which is akin to a static contraction type of exercise, for any selected type of exercise chosen, at any selected position within the normal bodily range of motion for that particular type of exercise, e.g. bicep curls, leg presses, etc. During an Isometric exercise, the range of motion of the user's limb or body part being exercised is simplified to a single point, and in such mode motor 25 resists all motion of cable 19 from such point. In such mode, if the user were to hypothetically release a grasping handle, etc. present at a resistance access point, the handle would merely drop downward solely under the influence of gravity.

Figure 15:
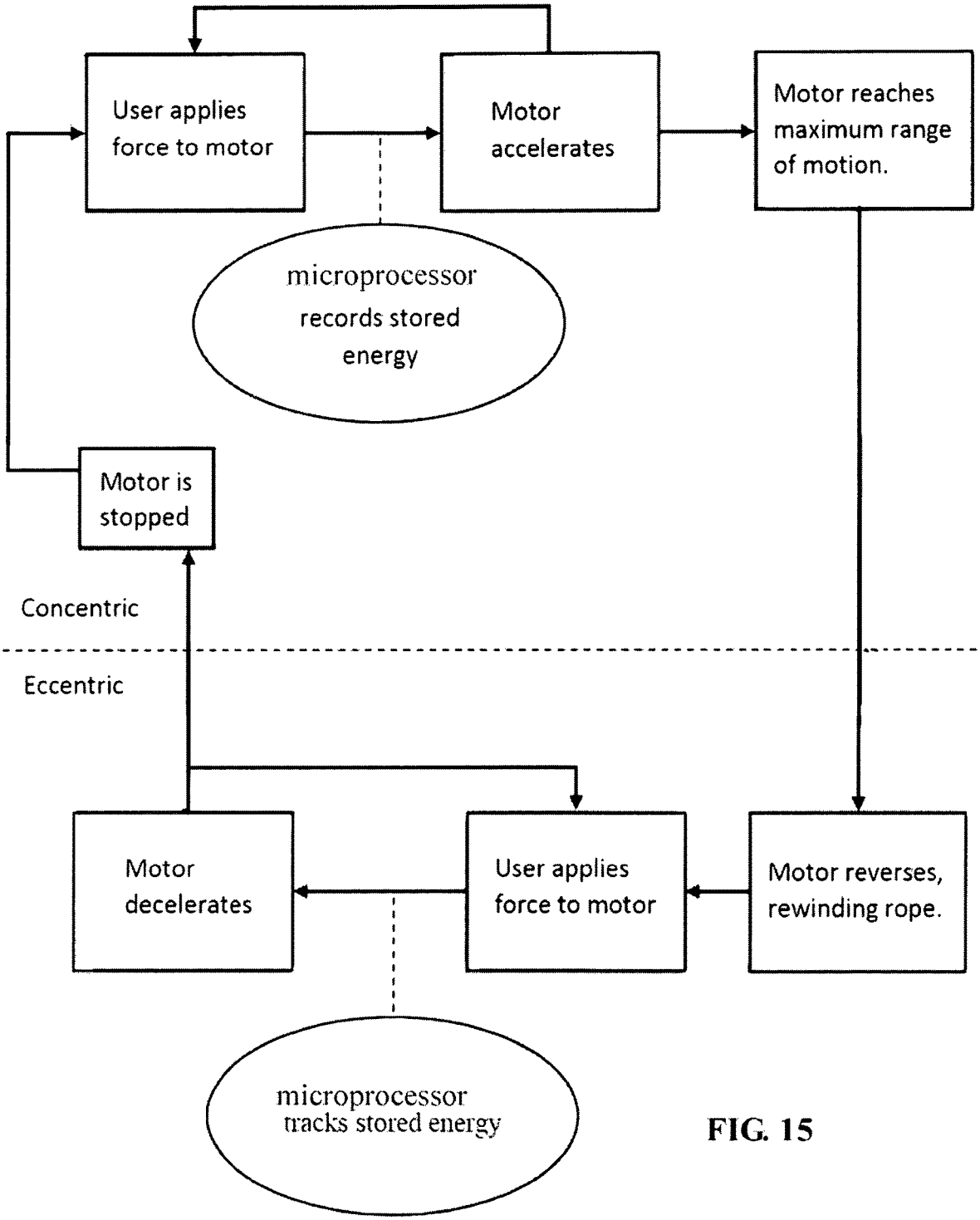
FIG. 15 is a schematic representation of events associated with an isoinertial mode of exercise according to some embodiments of the disclosure.

Another of the exercise modalities enabled by this disclosure is termed the Isoinertial mode. A general scheme of the isoinertial mode according to some embodiments is schematically depicted in FIG. 15. In the isoinertial mode, the motor is commanded to apply a steadily decreasing torque to cable 19 as a user pulls on a resistance access point at the end of cable 19, until the person's motion for the particular selected exercise has reached its maximum extension and cable 19 is also maximally extended for the particular exercise under consideration. At this point, which marks the beginning of the eccentric phase, microprocessor 97 commands motor 25 to rotate in the opposite direction with increasing torque on shaft 26 to match the increasing torque profile of a flywheel-based Isoinertial exercise device. As the user applies resistive force during the eccentric phase, motor 25 is slowed and eventually comes to a stop, as would a flywheel under the same scenario. Once motor 25 is stopped, any force applied by the user will accelerate the motor once again, and the foregoing cycle is repeated.

Another of the exercise modalities enabled by this disclosure is termed the Isoinertial-Isokinetic Hybrid mode. This mode is characterized by motor 25 being commanded to behave as a flywheel as for during a concentric phase of exercise, and then being commanded to switch to a purely constant speed for a subsequent eccentric phase of exercise until the minimum range of motion point for the user as previously calibrated for is reached. In this mode, microprocessor 97 commands the speed of motor 25 to change when transitioning between the concentric and eccentric directions of motion of cable 19. When switching back from eccentric phase to concentric phase, microprocessor 97 once again begins tracking the force applied to cable 19 by the user, and the effect such force has on the speed of rotation of motor shaft 26. These data are all stored in memory 219 for retrieval as desired or necessary. The Isoinertial-Isokinetic hybrid mode involves the system behaving as a flywheel for the entirety of the concentric mode, and then as an isokinetic system for the eccentric mode. Conventional isoinertial exercises have an inherent safety consideration in that when transitioning between concentric and eccentric motion, there is a jerking which could potentially injure a person. The instant system switches to isokinetic mode during the eccentric phase, which removes the potentiality for such jerking motion. During isoinertial-isokinetic hybrid mode, the system behaves as a flywheel during the entirety of the concentric motion, and switches to a constant speed during the eccentric phase of motion. When the user reaches their maximum range of motion, instead of retrieving the rope rapidly with considerable force, as a flywheel normally would, the isokinetic mode is used immediately. The key parameter for all isoinertial based modes is that of the inertial mass of the simulated flywheel. (Force)=(Mass)×(acceleration). In the case of a rotating flywheel, (Inertial mass/(radius^2)) is equivalent to a horizontally moving mass. As the flywheel is simulated, in some embodiments the radius is taken to be unity, for simplicity. As the user applies force, the system begins accelerating the motor based on the derived formula: (Acceleration)=(User applied force)/(Inertia variable). The effect of this acceleration is that the user must also accelerate in order to continue applying force. Were they to continue moving at a constant speed, they would keep pace with the motor and not do any work. In a traditional flywheel, the cable, having unwound completely, will begin rewinding in the opposite direction. The net effect being that whatever speed was achieved will immediately reverse. The system considers the momentum in the system at that point in time to be the (Inertial mass)*(current speed). During a purely isoinertial mode, the system transitions to that speed in reverse, and allows the user to apply force to slow the motor down. During an isoinertial-isokinetic hybrid mode, the speed at the end of the concentric phase is taken and used as the eccentric phase. This allows the user to resist, achieving eccentric overload style exercise. After the user reaches their minimum range of motion, the motor is stopped and the user may apply force again to accelerate the simulated mass.

System Initialization

In some embodiments, when a system of the disclosure is first turned on, an initialization sequence is executed. When the motor hardware is initialized the system performs a conventional self-test which involves testing a breaking resistor, testing that the motor encoder is present and providing data, and confirming that any fuses present are intact. The motor is set to the home position, and the load cell is calibrated. The user data is initialized by retrieving the appropriate user data from the database memory. User initialization is not necessary for the system to operate, however any data collected would not be associated with any user in such mode. Collectively, these steps comprise the logging in of a user and preparation of the system for use, analogous to a bootup sequence on a personal computer.

At the end of the system initialization, the zero point for the encoder is recorded. This represents what the encoder sees when cable 19 is completely wound on shaft 37. given the resolution of encoder 201 (impulses per rotation of shaft 37) and the diameter of shaft 37 and cable 19 in millimeters, the distance per encoder is derived from the formula: (Encoder Resolution)/((Pi)*(shaft diameter+cable diameter))=Impulses per millimeter. In some embodiments, encoder 201 has a resolution of approximately 110 impulses per millimeter. Given the zero point and encoder position at any given time, the amount of cable released from shaft 37 is determined by: ((Encoder Position)−(Zero Position)/(Impulses per Millimeter)=(Cable Displacement).

The speed at which cable 19 is moving is determined by two methods, and the values are compared for validity. The calculated displacement of cable 19 over time is provided by: (Speed in millimeters per second)=((Encoder Position T2)−(Encoder Position T1))/((Impulses per Millimeter)*(Shaft Diameter−Cable Diameter)*(Pi), wherein T1 and T2 reference the position of encoder at time 1 and time 2.

The speed of motor 25, as determined by microprocessor 97, accounting for the diameter of shaft 37 is (Speed in millimeters per second)=(Shaft rotations per second)*(Shaft Diameter+Cable Diameter)*(Pi).

For an isokinetic exercise, for which a user has requested a constant speed of cable release, the rotation rate of shaft 37 is determined by (Shaft Rotations/sec)=(Desired Speed in mm/sec)/((Shaft Diameter+Rope Diameter)*Pi.

In instances of isotonic exercise modalities, the desired torque is calculated. This is accomplished using either load cell 213 or torque sensor 211. When using torque sensor 211, the intrinsic properties of the motor are taken into account. During system construction and calibration, the ratio between one arbitrary unit of torque as specified to the motor control library and the load produced by the motor shaft is determined. From this, torque is calculated as (Torque)=(Desired Load)*(Identified Torque Ratio). Different motors 25 have different ratios. In some embodiments, a ratio of 115 was identified between reference weights and the torque as commanded to motor 25. In one example, for an isotonic exercise in which the user has requested a constant load of ten kilograms, the torque is calculated to be (Torque)=10*115=1150 Newton-Meters. In some embodiments the formula used is (Target Force) times (Shaft Radius) times (Mechanical Advantage)=(Torque). For instances of when a user is performing an isotonic exercise wherein they wish to have a resistance of 100 N on a single handle or access point, knowing that single handle exercises give the user a mechanical advantage of 2:1, and given a shaft radius of 25 mm, the motor is commanded to apply a torque of (100N)(0.025 m)(2.0)=5.0 Nm. When the user is holding the handle and the system is in equilibrium, the load cell will be reporting 200N to the system, but the user will be experiencing a total force of 100N. At this time, the feedback to the user will utilize either kilograms or pounds-force, showing them either 10.2 kg or 22.5 lbs. The system ignores for the purposes of feedback to the user, that pounds are a unit of force and kilograms are a unit of mass, and the system assumes that all users are familiar with the relative resistance to motion of objects in Earth gravity.

In general, load cell determination is known in the art, however, as part of the initialization procedure, the zero point is calibrated with respect to load cell 213 and the load cell value is taken to be whatever it reports, minus the calibration value.

At system startup, the functionality of motor 25 is validated, the position of cable 19 is determined, and the load cell is calibrated. After the microprocessor starts, it ensures that it is in communication with and can receive and send operational data from the motor, encoder, and load cell. The microprocessor then begins to retrieve any available cable in a manner similar to setting a range of motion, described below. Once the cable is fully retrieved, further motion of cable 19 would be resisted either by the motor itself, if the frame and pulley assembly is not present, or by the frame at the various exercise attachment points. The microprocessor records this point as the zero position of cable 19 for the encoder. Stated another way, the zero position of cable 19 is determined as being that position of cable 19 when it is completely retracted (fully wound on shaft 37).

In some embodiments a pulse count motion sensor is disposed in the proximity of shaft 37 for determining the angular position of shaft 37 at any point in real time. In alternate embodiments, position of shaft 37 is determined by an encoder. In alternate embodiments, an optical motion sensor is employed in place of an encoder. In other embodiments, a tachometer is used in conjunction with a device used to measure time, to determine the number of rotations of shaft 37 over any selected time interval, in the place of the encoder. In further alternate embodiments, methods disclosed in US Patent Publication 20110035041 are used, which disclosure is herein incorporated by reference.

Information relating to the position of shaft 37, coupled with the diameter of shaft 37 and the diameter of cable 19 permits microprocessor 97 to determine at any time, the amount of cable 19 which has been unwound from shaft 37 with respect to the zero position.

In some embodiments, once the zero point has been determined, cable 19 is unwound from shaft 37 slightly, which may be a few millimeters or less, so that cable 19 has no resistance and only minimal slack on it, and the value provided by the load cell for such relieved tension is recorded and stored in memory. This point is treated as an effective zero point for the load cell in some embodiments.

Range of Motion

Figure 16:
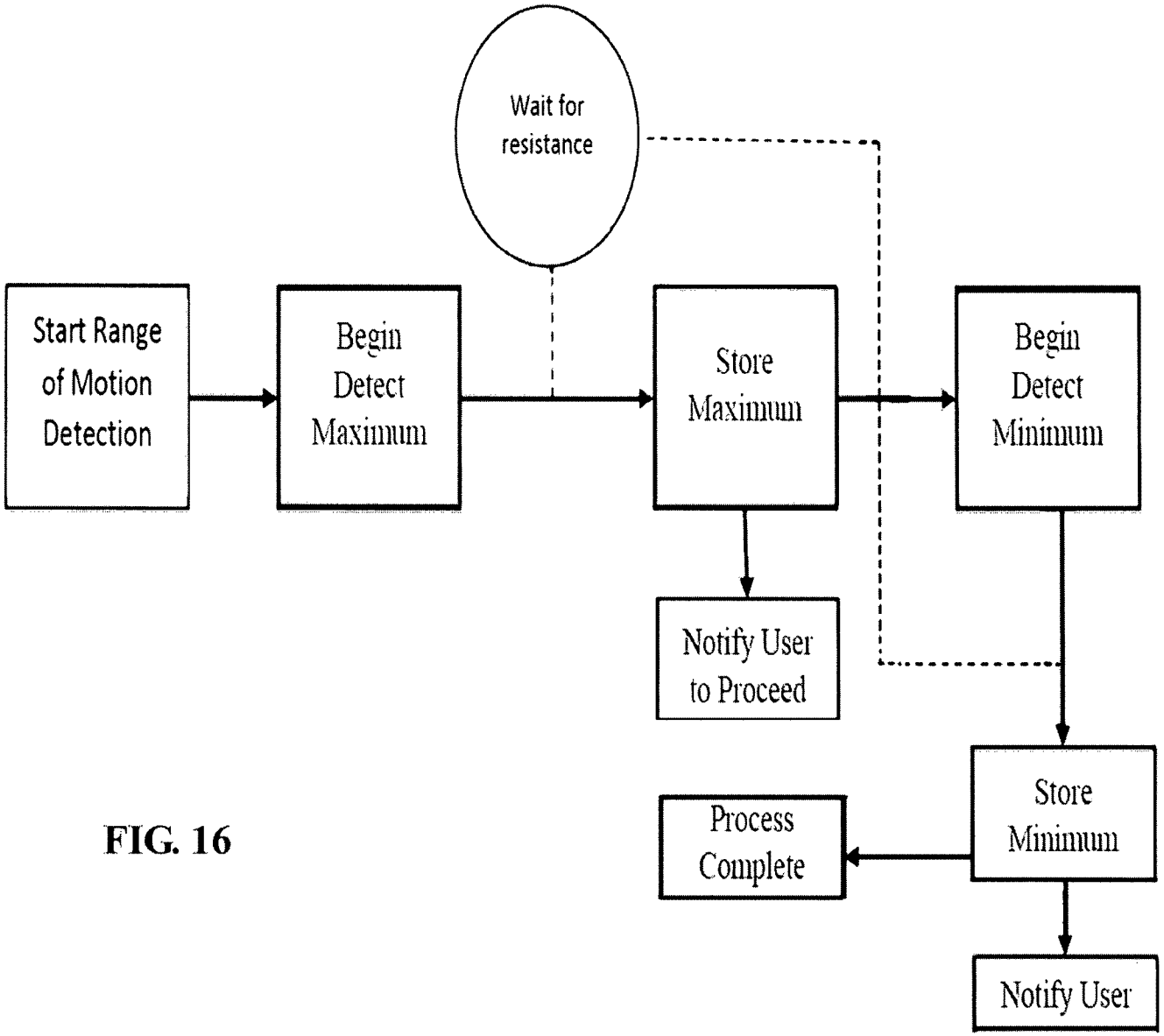
FIG. 16 is a flowchart of events associated with defining a range of motion of a user associated with a particular selected exercise according to some embodiments of the disclosure.

A system according to some embodiments of the invention generates and retains range-of-motion information relating to the motion of a particular body part such as an arm or leg of a person exercising using the system, during a particular selected exercise. When a user initially employs a system according to some embodiments, a range of motion for a selected exercise is defined, with reference to FIG. 16. Different exercises typically involve movements of different body parts; for example, a user's minimum and maximum range of motion range of motion for an isometric chest press differs from the minimum and maximum range of motion for an isokinetic chest press. The determined values of cable release for each of the maximum and minimum points of a range of motion for each selected exercise modality and phase are stored in different locations in memory. The starting and ending points of the range of motion of a body part for each modality and phase is determined and recorded in memory, which permits tracking of range of motion for a user with respect to a particular exercise over time. This also eliminates the need for re-acquisition of range of motion for a user with respect to each particular exercise selected at each exercise session. Thus, by having inputs to the microprocessor which are indicative of the zero, maximal and minimal amounts of extension of cable 19 from shaft 37 for each exercise and body part, a calibration is achieved. Once measured these parameters are stored into memory such as in a data map format in effective communication with microprocessor 97.

While in the range of motion setup process, motor 25 retracts cable at a constant speed as defined in the programming instructions. A minimal resistance is also defined, being that resistance which causes motor 25 to stop retracting cable 19. A minimal duration during which the user must provide such minimal resistance is also defined, to indicate to the system that the position of cable 19 at this point should be stored as the relevant minimal or maximal point in the range of motion. The process of defining a range of motion for a selected exercise generally includes the steps of: 1) informing the user that the system is in the mode of determining a range of motion; 2) commanding motor 25 to take up cable 19 on shaft 37 during a sensed first degree of resistance to more of cable 19 being taken up onto shaft 37, until a second degree of resistance to more of cable 19 being taken up onto shaft 37 is sensed by the torque sensor 211 or load cell 213. This point is interpreted by the microprocessor as the user providing the resistance to more of cable 19 being taken up on shaft 37, the degree of difference between the first sensed degree of resistance and second sensed resistance being at least three kilograms of force for one second; 3) recording the point at which such changed resistance occurs and ascribing this point as a maximum set point; 4) informing the user that the minimum set point is about to be determined; 5) commanding motor 25 to again take up cable 19 onto shaft 37 until a second increased degree of resistance to more of cable 19 being taken up onto shaft 37 is sensed by torque sensor 211; 6) recordation of the point of second increased degree of resistance as the minimum set point of the range of motion of the user for the particular selected exercise; and 7) notifying the user that the minimum of their range of motion for that exercise has been determined and that the determination of the range of motion for that exercise is complete. In some embodiments, the second increased degree of resistance of step 5) above occurs when a resistance access point or knot 52 reaches opening 54. In some embodiments, motor 25 is considered blocked when it cannot turn without exceeding a minimum threshold force. During setting of the range of motion, in some embodiments this minimum threshold is set to 30 Newtons. Thus, during establishment of range of motion, a person applies a cyclic force to a selected resistance access point. In its simplest sense, one cycle of a cyclic force is an extension and retraction of the cable to which the resistance access point is attached.

In general, a range of motion for all exercises undertaken on a system of the disclosure is determined in the foregoing manner. This enables the user to identify the extremes of motion during an exercise or exercise mode they are selecting to perform, within which they are comfortable exercising.

In some alternate embodiments, the system is programmed to enable the user to manually enter the range of motion. Since the position of cable 19 is being constantly tracked by the system, in some embodiments a user may pull on cable 19 until they reach their minimum or maximum point in the range of motion for a selected exercise, and at this point provide an indication to the system, such as by pressing a button, that the location of cable 19 at the point at which the indication is provided is either a minimum and maximum point.

The range of motion determination is useful in the event microprocessor 97 senses during a selected exercise that cable 19 is not at a position between the minimum and maximum points of the range of motion. The system considers such a situation as an abnormal condition, and one which may result in termination of the particular selected exercise.

In some embodiments, the system uses the information that cable 19 is at or near either a maximum or minimum point in a selected exercise, to switch motor 25 from operating in concentric to eccentric modes, or vice versa. Both proportional to range of motion or absolute values would be acceptable. In some embodiments a change from one phase to the other is considered to have occurred when the user gets within two centimeters of the transition threshold when transitioning between concentric and eccentric. In some embodiments, during an isokinetic type exercise, where the motor retrieves cable for the entirety of the eccentric phase, the phase transition back to concentric occurs immediately when the user passes the minimum range of motion for the particular exercise.

In some embodiments while performing an exercise, the range of motion is dynamically narrowed. This feature enables a user increased economy in exercising, when they are beginning to experience fatigue. User fatigue is indicated by a rapid decrease in the user's force output during a concentric phase, and can sometimes be accompanied by motor 25 temporarily stopping operation due to a lack of force being applied, as mentioned elsewhere herein. In such instances using the current technology, the user can be induced to continue exercising by changing the maximum point in the range of motion to a point more toward the minimum point in the range of motion, thus enabling the user to achieve motion to the new maximum point during the exercise. When such functionality is enabled, the range of motion may be narrowed to promote the continued effort of the user. When examining the force exerted during the concentric phase of motion, as evaluated over the previous four repetitions, if the most recent average force is less than a defined fatigue threshold relative to the maximum average of the previous repetitions, expressed as a percentage, the maximum range of motion is reduced by a defined reduction parameter. In some embodiments, the percentages of 50% and 20%, respectively, are used. However these amounts can be tailored by system engineers to essentially any desired value. Thus, in some embodiments, if the average concentric force is less than 50% of the greatest average concentric force during one of the previous four repetitions, the system causes the maximum range of motion to be reduced by 20%.

Descriptive operational parameters of such narrowing of the range of motion are stored in system memory for access at any selected future point in time, and in one aspect of the current technology, such information can be generated on a first particular piece of exercise equipment and later recalled and processed when a user is exercising on a second particular piece of exercise equipment. The result is that the data generated from the first piece of exercise equipment is useful on other equipment equipped with the instant technology.

A system of the invention also provides user access to externally collected data, including their weight, bodily composition, heart rate, and blood pressure over time. In some embodiments, this information is tracked and recorded in real time.

Operation

Once the range of motion has been calibrated, the system is ready to be used for an exercise. In the software, if a user logs in at a user interface (which may comprise a keypad and screen, or a touch screen) either by means of a username and password or other personally identifying item such as an RFID chip, QR code or biometric identification, the system accesses the person's historical data and may or may not utilize the user's stored range of motion, depending upon the user's preference.

For instances in which the system determines that the particular user who is logged in has performed a particular exercise previously, in some embodiments the user's previously recorded range of motion data is retrieved from memory. In other embodiments, the system enables the user to command the system to again determine the user's range of motion for a particular selected exercise or exercise mode.

After a selected exercise has been performed by a user, the system records data gathered from the various sensors into system memory. This includes: a timestamp, the exercise type, the duration of the selected exercise, the initial maximum range of motion, the initial minimum range of motion, the final maximum range of motion, the final minimum range of motion, the maximum eccentric force per repetition, the maximum concentric force per repetition, the maximum overall eccentric force, the maximum overall concentric force, the average eccentric force over the course of a repetition (per repetition), the average concentric force over the course of a repetition (per repetition), the average overall concentric force, average overall eccentric force, the total work performed, the time per repetition, and the average time per repetition. By manipulating the data by various formulae, useful information relating to a users exercises is determined, including the percent change in range of motion from previous exercise session, percent change in maximum eccentric/concentric force, and percent change in average eccentric/concentric force.

After a selected exercise has been performed by a user, the maximal eccentric and concentric force applied by a user during an exercise is determined based on the maximum value reported by the load cell during the course of a given repetition, specific to the phase under consideration (eccentric or concentric). During the course of a given phase, the maximum value reported is always the then-current maximum, such that a user may see their maximum increase during the course of a given eccentric or concentric movement. In some embodiments, during a given exercise phase (eccentric or concentric), the current maximum force is determined as: (Max force)=((Current Force)>(Max force)) ? (Current Force):(Max force). Thus, if the current force at an observed instant is greater than the maximum force value stored in memory for the particular repetition of the particular exercise being performed, then the maximum force value stored in memory is updated to the current force observed. When the user reaches a transition to a new phase, the per repetition maximum is reset.

Further, after a selected exercise has been performed by a user, the average eccentric and concentric force values are determined by taking the arithmetic mean of all force values reported during the course of a given phase.

Further, after a selected exercise has been performed by a user, the number of repetitions of a particular exercise is determined from counting the number of times the user has completed both an eccentric and a concentric phase of motion for a given selected exercise.

Further, after a selected exercise has been performed by a user, the total duration of an exercise is determined. The total duration of the exercise is the amount of time elapsed beginning from the moment the microprocessor receives the command to begin an exercise. Any time during which the user was too weak to continue may be included in optional calculation modes.

Additionally, after a selected exercise has been performed by a user, an average repetition duration time is determined, which is understood to be the average time elapsed between successive transitions from concentric to eccentric phases during a particular selected exercise (i.e. the time it takes to return to the start of the eccentric phase again).

During a particular selected exercise or exercise mode, the system provides visual feedback to a user via a display screen or printout, which feedback relates to their current or present force output in real time for a particular selected exercise or exercise mode. In some embodiments, the user interface is programmed and/or configured to retrieve the currently observed ("current") load cell reading on a regular basis, sometimes at 100 ms intervals, and creates one or a plurality of graphs to display to the user. The graph shown relates to the data to be displayed, and is generated using conventional graphing software. In some embodiments, the force exerted by the user in real time is represented graphically as a moving line graph with force as a function of time, wherein each load cell reading collected is added to the data set provided to a graphing library or database for storing force data sampled, which is retrieved, processed, and converted into a visual graphical display. In some instances, the average force exerted by a user over any selected time interval is visually expressed as a bar graph. Once a load cell reading is output to the processor, a current average value is calculated and the data set is updated with a new average value for the current repetition of the particular exercise selected, which adds a new bar to the bar graph. In some instances where "inroad" is to be displayed, a single numerical value is displayed. In some embodiments, the inroad value is expressed in percentage form as (100%−(Current Rep Average Eccentric Force)/(Max Average Eccentric Force)). Thus, if a user is completely fatigued, they would have a current average eccentric force of zero, which would correlate with a 100% inroad. In some instances, an analog speedometer style graphical display is provided, having a low, medium, and high range. In some instances when displaying such a graph, the boundaries between the low, medium, and high regions denote the previous exercise session's average force and maximum force, such that once a user crosses the boundary to the "high" range, they know that they are exceeding their previous maximum.

Visual feedback is in some embodiments provided by one or more display screens attached to the system or disposed in its vicinity. In some embodiments, two monitors are employed, one being disposed in front of the user, and a second being disposed above the user, to enable the user to read the display screen when performing reclined exercises. Such a heads up display allows the user to see their performance in real time. In some other embodiments, feedback is provided using simple digital readouts, such as a dashboard containing force and time counts, or visual cues, such as LED strips to indicate what the user should be performing. In some embodiments auditory cues such as a tone or beep are provided to indicate a change in phase during an exercise relating to a changing phase in the range of motion for a particular selected exercise. Optional embodiments employ bar graphs, line graphs, and real-time force readouts, as well as simple textual output. In some embodiments an analog speedometer style display is used to output the current force being exerted by a user. When a user has performed the given exercise previously, the speedometer-type of display reflects this with color coded regions indicating a previous average and previous maximum, allowing the user a visual comparison of their current performance vs. their own historical performance relating to a selected exercise, giving them a target to strive for in order to achieve progress.

A system according to the disclosure is also able, when a person is not performing an exercise, to draw out from memory and display on a screen various forms of historical data generated by a particular user in the past with respect to any one or more than one of the exercises or exercise modes for which the system is capable of recording data. Such information is useful to convey performance trends, and progress towards achievement of goals. In some embodiments, the body composition of the user at the present time is compared to their body composition in the past, to generate an indication of progress towards one or more goals. In some embodiments the load cell is the sensor from which data for generating all force-related graphic visual displays is derived. However, additional sensor output from any selected transducer which outputs data or values proportional to force exerted by a user during an exercise can be optionally used.

Historical data is presented both as a bar or line graph, where applicable, or as a simple reference (for example, showing the previous exercise sessions' speedometer). Users have access to historical data for all exercises they perform, including their maximum and average force and duration. The system tracks the body composition, weight heart rate and blood pressure, and supports tracking additional bodily information data when optional sensors such as respirometer, heart rate, and skin conductivity are fed as inputs to microprocessor 97.

Microprocessor

A system of the disclosure employs a microprocessor 97 as depicted schematically in FIG. 12, which can be any microprocessor capable of receiving a plurality of input signals, executing user-defined programs and sub-routines, and providing outputs responsive to the inputs and/or programming. The microprocessor can be essentially any programmable microprocessor, including some consumer types such as commonly found on Blackberry® Pi devices or Arduino type chips. In some embodiments, the microprocessor is selected to be a STM32 ® microprocessor available from ST Microelectronics of Coppell, Tex.

In general, microprocessor 97 is in effective communication with memory 219, containing executable instructions. It is understood that memory 219 is used generically in the schematic of FIG. 12 and in some embodiments more than one memory bank or source is provided in effective communication with microprocessor 97. Memory can be flash memory, non-volatile system memory, NAND memory, or any conventional memory employed in a data processing system, such as any PC computers having a physical hard drive. This includes memory useful in an information handling system, as described in U.S. Pat. No. 10,033,663 which is herein incorporated by reference. In some alternate embodiments, a sequence of commands are pre-programmed into memory effectively in communication with microprocessor 97, which commands cause motor 25 to be energized to operate at pre-selected speeds of rotation and torque outputs responsive to inputs and the programming instructions present, programmed or otherwise embedded in the memory as executable files or made available to an executable file. In some embodiments, instructions and commands are provided to microprocessor 97 by an RS-232 serial port or functionally-equivalent network connection, and in other embodiments instructions and commands are provided to microprocessor 97 by a wireless connection, which includes without limitation Bluetooth radio transceiver devices. Upon execution or receipt of an instruction or command based on inputs and/or programming instructions, microprocessor 97 outputs a signal that adjusts the voltage and/or electrical current supplied to motor 25, to produce any pre-selected or pre-defined level of speed and/or torque, or any pre-selected or pre-defined profile of speed and/or torque over any time period selected.

In general a microprocessor employed in connection with the instant technology has a plurality of inputs and outputs. Some of the outputs of microprocessor 97 which controls motor 25 in some embodiments include: 1) commands which control the maximal force output of the motor, for both eccentric and concentric phases of exercise; 2) an output of the average force output of motor 25 over a given range of motion, per repetition of a particular selected exercise; 3) total work performed by a user during a particular selected exercise; 4) total time a user is under load for a given exercise; 5) work performed by a user in a current exercise as compared to work expended in the same exercise on any one or more than one previous occasions, or an average thereof; 6) work performed by a user as compared to any target or reference value of work; 7) current bodily composition including in terms of fat percentage vs. lean muscle percentage, as compared to previous points in time; 8) current total body weight as compared to previous points in time; 9) muscle inroad, which is a measure of the degree to which a muscle or any selected groups of muscles is or has been fatigued, for instances of both eccentric and concentric phases of any particular selected exercise; and 10) load as a percentage of body weight, which is used in determination of skeletal growth signaling. In some embodiments, load is defined as the force being exerted upon the user during an eccentric movement, and in some alternate embodiments as the force being exerted by the user during either a concentric motion or isometric exercise.

Inputs to microprocessor 97 in some embodiments include: 1) input from encoder 201; 2) Output of torque sensor 211; 3) Output of load cell 213; 4) Power voltage; 5) Brake voltage; and 6) Power temperature. Outputs of microprocessor 97 in some embodiments include: 1) any or all input data when used in calculations performed within microprocessor 97; 2) Displacement of cable 19; 3) Current speed; 4) Current repetition number; and 5) Current phase (eccentric or concentric).

Towards maintaining a desired pre-selected operation of motor 25, encoder 201 provides a signal to microprocessor 97 which is programmed to automatically alter or maintain the supply voltage and/or current to motor 25 responsive to the voltage signal provided by encoder 201. Thus, via programming in some embodiments, microprocessor logic operates in a continuous loop mode wherein the speed and position of the motor are repeatedly re-determined at regular intervals by means of sensor data, which intervals can be any selected intervals from every one millisecond, to every one second, including any selected intervals therebetween.

Based on the output signal of encoder 201, microprocessor 97 is able to determine the amount of cable 19 that has been released from shaft 37 at any given point in time. Moreover, data from torque sensor 211 and load cell 213 inputted to microprocessor 97 enables microprocessor 97 to determine the amount of force being exerted by motor 25 against cable 19 at any given point in time. These data enable microprocessor 97 to determine how much of cable 19 the user has pulled away from a system such as exercise system 22 at any time, during any selected particular exercise, and whether motor 25 is exerting a force on cable 19 and whether and at what rate the force is causing cable 19 to move.

Commands to motor 25 include specifying a torque-based operation and the specific torque to use, and specifying a speed-based operation and the reference speed to use. The microprocessor itself can be communicated with via any protocol earlier specified though most embodiments would likely utilize a local network of some kind, either direct physical connection such as with RS 232 or USB, local area network or local wireless connectivity.

Motor Operation

Motor 25 is capable of operating in two general modes. The first mode is to provide constant torque, independent of the speed (which can vary in this mode) of rotation of motor 25. In constant torque mode, motor shaft 26 provides a constant torque output. Thus, in constant torque mode, in the absence of any resistance, shaft 26 rotates with a constant torque output. In some embodiments of this modality, motor shaft 26 is stationary, requiring a minimum pre-set amount specified of minimum torque to cause shaft 26 to rotate, from force transmitted from a user via cable 19. When cable 19, which is in effective mechanical contact with shaft 26, is pulled with a force greater than the pre-specified minimum torque required to rotate shaft 26, shaft 26 rotates with a constant torque output. This means that when a selected exercise is being performed in a purely isotonic mode, the resistance at the stopping points of a resistance access point 3 provide torque equal to that being output by motor 25. When a user subsequently grasps a resistance access point 3 and provides a force that exceeds the torque that motor 25 is outputting, shaft 26 rotates responsive to the user's excess force. This situation is analogous to, and mimics a conventional weight stack, which does not move until a user provides a sufficient minimum force necessary to overcome gravitational attraction of the weight stack and enable it to move upwardly.

The second general mode which motor 25 is capable of operating under is that of constant speed of rotation of shaft 26, independent of the torque output (which can vary in this mode) of motor 25. In this modality, motor 25 operates at a fixed speed of rotation, regardless of the amount of force provided by a user acting through cable 19. This situation is analogous to a controlled exercise motion, excepting that the user is able to fully exert themselves, thereby allowing for maximal muscle exertion while the controlled speed is maintained.

One distinction between motor 25 being in constant-speed vs. constant-torque modes is that with constant-torque operation, the user can change or control the speed by providing sufficient force during isotonic or isoinertial exercise modes. In constant-speed operation, this ability is not afforded to the user.

The amount of torque which motor 25 is commanded to produce is controlled by microprocessor 97, as guided by requests from the user. If a user chooses an isotonic mode of exercise with the goal of replicating a 200 Newtons resistance force, for example, the torque is calculated to mimic that amount of force. In some embodiments of isoinertial mode, torque is determined iteratively, with the torque output at shaft 26 at any moment being subject to both the modeled resting inertia of the system and the aggregate force which the user has applied to cable 19.

The amount of force being applied to shaft 26 of motor 25 by way of a user exercising at a resistance access point and thereby transmitting a force to motor shaft via cable 19 is repeatedly determined by the system, by either torque sensor 211 or load cell 213, which in some embodiments takes place in small time intervals on the order often (10) milliseconds. In some embodiments the force applied to the shaft 26 of motor 25 is being re-determined and provided as an input for calculations undertaken by microprocessor 97. In such embodiments, microprocessor 97 operates effectively in an infinite loop mode, performing determinations of applied force repeatedly, and when operating in an exercise mode, the results of a first iteration are used to determine the initial state for a subsequent iteration, and so on. Thus, for example when operating in isoinertial mode, the speed of shaft 26 is increased as the total force the user has applied to resistance access point 3 accrues.

Once the speed of rotation of motor 25, the position of the user's body part within its range of motion for a selected exercise, and the amount of force being applied to cable 19 has been determined, these data are used to provide instructions which command changes in the operation of motor 25, either its speed of rotation or torque output. The commanded changes to operation of motor 25 in some embodiments includes safety-related determinations such as whether the selected exercise being used should end or not, as well as operating mode changes. In some embodiments, when a user has reached or temporarily exceeded their maximal range of motion, motor 25 is commanded to reverse the rotation of shaft 26, switching from concentric to eccentric motion.

Sensor Data

Systems according to various embodiments of the instant technology utilize inputs derived from various sensors. By incorporating data both from the resistance unit 12 and from additional sensors, a system according to the disclosure provides a user with a historical view of not only their strength training but also their body composition and weight, which provides a better qualitative analysis of how their body makeup is being directly impacted by their training using devices and systems which embody the teachings of this disclosure.

Sensors used for data collection provide data from both within the system, and outside the system. This enables a user to be provided with a comprehensive analytical picture of their strength training results than is possible when using prior art systems and methods. Examples of types of sensors used for data collection within the system include load cell 213, and in some embodiments a CAN bus is employed for supporting external sensors such as heart rate sensors, respirometry sensors, blood pressure sensors, skin conductivity sensors, body composition sensors, weight sensors, and electrocardiogram sensors. The data from these sensors is stored for later retrieval, either during an exercise or during coaching outside an exercise.

Beyond simple metrics relating to the body of a user itself, sensors can be leveraged within the system to provide exercise guidance. For example, a pressure sensor on the floor is used in some embodiments to indicate whether a user is present or not at a particular location with respect to system 22 for a selected exercise. Data from such a pressure sensor is provided as an input to microprocessor 97, which can be used as the basis for triggering an emergency stop state or alternately, provide feedback to the user as an indication of effort expended during a particular exercise.

In some embodiments, sensor data is continuously input to the microprocessor 97 which results in the continuous monitoring of the force applied by the person exercising using the system by load cell 213. Some of such sensors are supplied with a voltage, which varies in proportion to variances in the load on cable 19. When the system is at rest, the only load on load cell 213 is cable 19 hanging beneath it, and its own weight.

The safety factor of use of any exercise equipment frame to which a device and system according to this disclosure is attached is enhanced, because the system is configured or programmed to cease application of force upon sensing a person exercising using the system has ceased resisting the force applied by motor 25.

A simple optical heart rate sensor simply provides a signal when the heart beats. As the cycle time of the microprocessor 97 far exceeds the maximum heart rate, this can be tracked. In some embodiments, data from sensors is communicated to microprocessor 97 using wireless communication, such as by Bluetooth protocol.

Exercises Updates Features

A system according to the disclosure enables the modification of any one or more than one of the independently selected exercise parameters of minimum point in the range of motion, maximum point in the range of motion, eccentric speed, and concentric speed during any exercise mode selected by a user. When in an isoinertial mode, the system permits the inertial mass to be changed. When considering the force exerted during the concentric phase of motion, as evaluated over a previous set of repetitions for a particular selected exercise, say, 4 repetitions, if the most recent average force is less than any pre-selected defined fatigue threshold relative to the maximum average of the previous repetitions, expressed as a percentage, the concentric speed is increased by a pre-selected, defined reduction parameter. In some embodiments, values of 50% and 0.2, respectively, are the pre-selected values. However, system engineers can select any values for these parameters as they deem desirable. Thus, if the average concentric force is less than 50% of the greatest average concentric force during one of the previous 4 repetitions, the concentric speed is increased by 0.2 m/s. These two adjustment mechanisms may be used independently or concurrently, as desired by system engineers.

Any changes in the speed or torque output of motor 25 based on changes in any of the aforementioned parameters during any selected exercise mode are commanded to motor 25 by microprocessor 97 as changes of torque and/or speed of rotation of shaft 37 versus the torque and/or speed commanded by microprocessor 97 to motor 25 prior to such modifications. Thus, during a given exercise, any parameter pertinent to that exercise can be modified. Table I below lists all exercises enabled by the current system, and next to each entry are the parameters pertinent to that particular exercise.

TABLE I

| Exercise | parameters pertinent to that exercise |
|---|---|
| isokinetic | min and max range of motion; eccentric and concentric speed, concentric force threshold |
| isotonic | minimum and maximum range of motion; eccentric and concentric simulated weight |
| isoinertial | minimum and maximum range of motion; flywheel inertia, eccentric speed (for hybrid mode) |
| isometric | cable 19 displacement position |

From Table I, concentric force threshold means the minimum force required from user to indicate that they are providing resistance such that motor 25 permits shaft 37 to rotate in order that cable 19 is unwound therefrom.

Changes to speed parameters are applied immediately if the user is in the mode that is being modified, or at the start of the next instance of that mode. Changes to the range of motion are also applied immediately. For instances in which a change in the range of motion is made, if the current position of cable 19 is outside the new range of motion for the particular selected exercise, the phase is adjusted to represent a change from eccentric to concentric (or vice versa), accordingly, to pull cable 19 back into the valid range of motion for the particular selected exercise.

In the case of the isometric mode, a change in displacement of cable 19 causes motor 25 to temporarily engage and microprocessor 97 is configured to command motor 25 to cause shaft 37 to either release or take up an appropriate length of cable 19 to compensate and move cable 19 to the appropriate position.

Changes in force when in isotonic mode to mimic a weight change is accomplished from microprocessor 97 immediately by commanding motor 25 to provide a different level of constant torque output. In some embodiments, the rate at which a user can apply such changes is limited, to avoid the scenario where a user applies a considerable change and is surprised by a sudden, overwhelming increase in force.

For instances in which the inertial moment of a virtual flywheel is changed during an isoinertial exercise using the instant system, the apparent speed of the flywheel is maintained by adjusting the accrued force proportionally vs. maintaining the accrued speed and causing a sudden change in the speed. When adjusting the inertial mass of the virtual flywheel, the accrued speed is held constant, and the new inertial mass is utilized when calculating the impact of additional force applied by the user for a selected exercise. When transitioning from Concentric to Eccentric phases, the speed will invert normally, and the user provides the force necessary to slow the unit to a stop. That is, the accrued force is immediately treated as if it were proportional to the new inertial mass.

In some embodiments a user or trainer may modify the foregoing parameters via the user interface software, using buttons to change whether a selected exercise is to be performed in isoinertial or isokinetic mode. Range of motion maximum and minimum points of cable, for example reducing a maximum range of motion when it is determined that under load it is further than a user can achieve, is useful Inertial mass and eccentric speed can also be selected or changed. When in isometric mode, the position of the cable 19 is the relevant parameter which can be changed.

When algorithmic methods are used to accomplish changes to the foregoing parameters, fatigue-based ranges of motion and speed adjustments are defined by the microprocessor based on changes in the range of motion of the user during a particular exercise. In some embodiments, this is based on detection of when the user's muscles are beginning to fatigue, as evidenced by the range of motion sensed being narrower than when the particular exercise was initialized. The speed of shaft 37 is similarly automatically adjusted to be increased in some embodiments when fatigue is detected based on a narrowed range of motion.

Software

Software useful in conjunction with devices and methods of the present disclosure provides for a user to store their workout results in database memory, which database can be a local database or a remote database. In some embodiments the database is a secure database, accessible by username and password protocol. Such stored exercise data can be retrieved at a future point in time, when desired. Such feature enables a user to move between multiple devices employing the features of the instant technology, without requiring any re-calibration of the person's range of motion.

This enables a consistent and unified training experience, which aids in both the efficacy of the training regimen and safety of the exercise experience. In some embodiments, data generated by a user during exercise is available directly at the machine being used and is optionally deleted from memory after a workout session is complete. In some embodiments, the data is saved only locally. One example of software code which enables all functions described herein is found in Applicant's provisional application 62/917,097 which is herein fully incorporated by reference.

In some embodiments, the operation of motor 25 including its speed, torque output, direction, and resistance to a force applied to its shaft 26 by a user acting on cable 19 is controlled by voltage and current commands outputted by microprocessor 97 in the form of electrical signals to a signal-responsive motor controller, which supplies the EMF to motor 25. Such motor controllers are well-known in the art for quite some time. The functions of microprocessor 97 are effected by a series of commands from control software.

Control software can be of many equivalent forms for carrying out the functions described herein, which include without limitation: 1) calibrating a range of motion for a user for a particular selected exercise; 2) retrieving a previously calibrated range of motion for a user that is associated with a previously-performed particular exercise; 3) receiving instructions for selecting an exercise modality; 4) determining the speed of rotation of motor 25 during eccentric and/or concentric phases for the isokinetic modality of exercise according to the disclosure; and 5) determining the force applied by motor 25 on cable 19 during the eccentric and/or concentric phases of the isotonic modality of exercise. In general, control software is responsible for communicating with the database, retrieving the user's previous exercises, including providing initial settings for range of motion based on those.

In some embodiments, microprocessor 97 is connected to a motor control board, as in the case when a motor control such as STM3210B-MCKIT from ST Microelectronics Co. is selected to be used. In some embodiments, there is another microprocessor such as ATMEL® processors including without limitation the ATMEL® ATxmega16D4 to control motor 25, which microprocessor receives commands from microprocessor 97. Other processors including ZILOG® Z16FMC are suitable as those of ordinary skill in the art appreciate.

User Database

Figure 17:
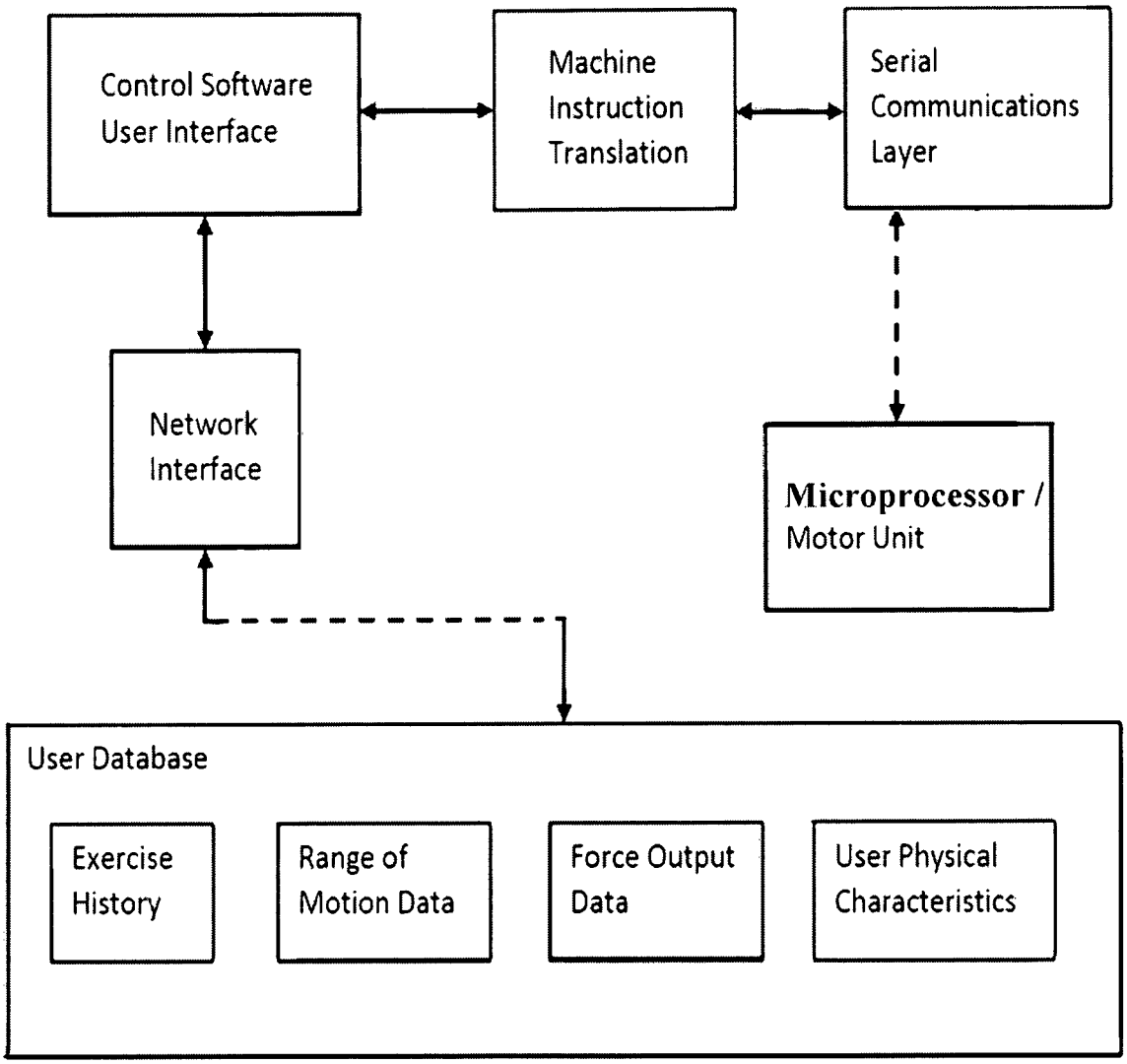
FIG. 17 is a schematic representation of interconnection between control software and a user database according to some embodiments of the disclosure.

Within memory 219 there is provided a sector for storing a user database. The control software used for operating the instant system has a network interface for communicating with the user database, which network interface can be any useful interface. In some embodiments, TCP/IP is employed as the primary network access protocol. In some embodiments, internet or network based databases are used, and accessed via a REST-based programming interface. In such embodiments, commands are provided as requests over HTTPS. A general arrangement of the control software in connection with the user database is shown schematically in FIG. 17.

The user database is programmed to contain and store information including the identity of a particular user, and their historical exercise data. Having historical exercise data stored in memory is useful for making comparisons with results from recent exercises to data generated and stored from the same exercises in the past. The network interface is of any common networking type, generally TCP/IP. The database itself can be of any known type, including both locally on the same system with the control software, or on a secured server on the internet. Some embodiments employ a secured server that is accessible over the internet.

In some embodiments the user database contains information relating to the range of motion of a user for the particular exercises they have previously conducted. This can be accessed at the onset of a current exercise, eliminating the need to re-calibrate the range of motion for a particular selected exercise, thereby simplifying or saving time at the setup or beginning of an exercise routine.

The user database in some embodiments also contains physical data related to the user that does not directly affect the operation of the system, or the torque and speed of motor 25 but which may be useful to the user for monitoring their exercise results. Such data can include without limitation: body mass index, body fat content, body composition, data relating to calories expended during a particular selected exercise, historical respiratory data, and historical cardiac-related data.

Safety

Selectively loading the muscles of an exercising person with variable amounts of force can sometimes be potentially problematic with respect to safety issues. The present disclosure enhances exercise equipment by introducing safety protocols that prevent user injury, even under situations of egregious misuse. This is accomplished via computer software which interfaces with motor 25, either directly or wirelessly, and instructs or commands motor 25 exactly how much force should be applied at all points in time over the full range of motion of a particular exercise. Optional embodiments provide ranges of permissible force at each point in time. Such provision enables a user to experience resistance equivalent to the force they are able to produce along the entire range of motion, which permits the proper recruitment of as many muscle fibers as possible, enabling muscles to fatigue properly to promote maximal muscle growth.

In some embodiments a system of the disclosure eliminates safety considerations by continuously monitoring the user's current position in their range of motion, the total force being applied by both the user and motor 25, the total speed of cable 19 as it is in motion in a device or system according to the disclosure, and the user's level of fatigue. In instances where any one or more than one of these values falls outside of a pre-selected expected range, a device according to the disclosure causes motor 25 to cease providing any resistance responsive to sensing such values outside the pre-selected range, which permits the user to relax or stop their exercising all together, with no danger of harm to themselves. Such feature enables for a scenario where a user simply stops providing resistive force to cable 19 (which may imply a fatigued or weak user), the system continues operating and provides resistance once again in response to the user thereafter once again providing a force or a resistance. Thus, in some embodiments of the instant technology, a user can stop any selected exercise at any selected time and the system effectively goes idle until the user once again provides a force or a resistance.

In some embodiments, an emergency safety stop button is provided on a system of the disclosure, which when depressed breaks the circuit that feeds current to motor 25. In some embodiments, multiple safety stop buttons are employed and present at any selected locations on system 22, the stop buttons being normally-closed switches, wired in series. An additional safety measure is provide to also protect motor 25, which is programming in microprocessor 97 that stops current from being applied to motor 25 when a pre-selected threshold level of torque is experienced by shaft 26.

In some embodiments, the system is programmed so that if a user ceases suddenly to exert any force, microprocessor 97 senses this via load cell 213 and de-energizes motor 25 in order that it ceases providing any torque that provides resistive force to the user via cable 19. This provides enhanced safety to a user, when compared to a conventional bench press exercise setup in which a user releases a barbell when it is in an elevated position above the person with disastrous results. In the present system, when cessation of application of force by a user is sensed, the microprocessor commands motor 25 to become de-energized and cable 19 becomes slack.

As a safety feature, in some embodiments, for the hypothetical situation where the user were to release a grasping handle, or other physical article such as a bench press bar present at a resistance access point prior the minimum of range of motion has been detected when operating in the isokinetic mode, motor 25 is commanded to continue taking up cable 19 onto shaft 37 but only up to the point where the length of cable 19 taken up onto shaft 37 is equivalent to the amount of cable present thereon at the previously-determined minimum point in the range of motion for the user for that particular selected exercise. The safety mechanism described here, whereby the motor does not shut off but continues at a set speed to the determined minimal range of motion and then stops, is suitable for use as a safety mechanism utilized in isokinetic mode.

In addition to providing the basis of the safety functionality, such responsive determinations and calculations enable conventional and novel, non-conventional exercise modalities to be provided by various embodiments of systems of this disclosure. In some embodiments, microprocessor 97 specifies the speed or torque that motor 25 should provide, rather than calculating it. A measure of how closely the motor output speed and/or torque actually reflects what it has been commanded is determined from inputs provided by encoder 201 and load cell 213 and torque sensor 211.

Figure 19:
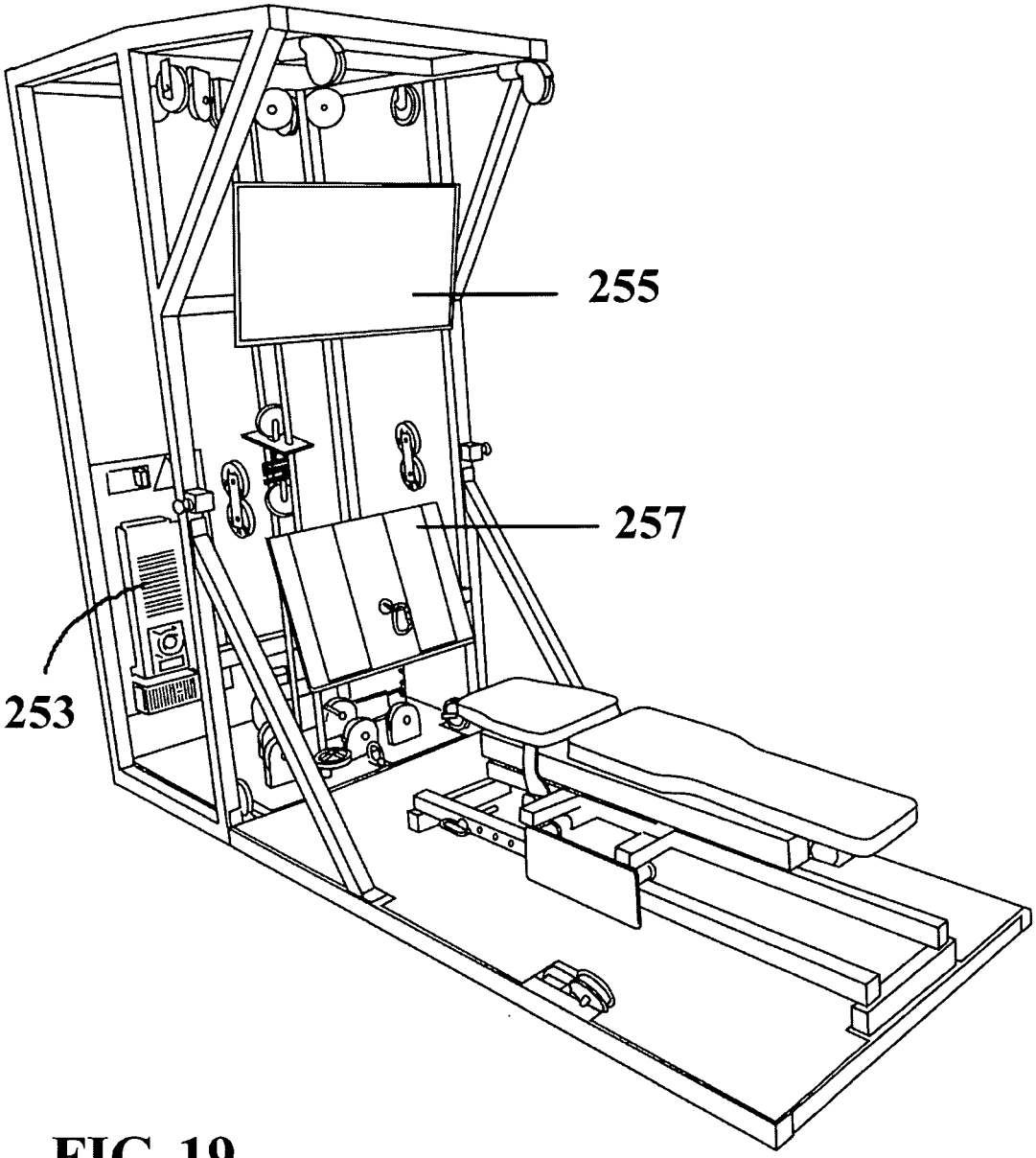
FIG. 19 is a perspective view of an exercise system framework useful in some alternate embodiments of the invention, showing additional features.
Figure 20:
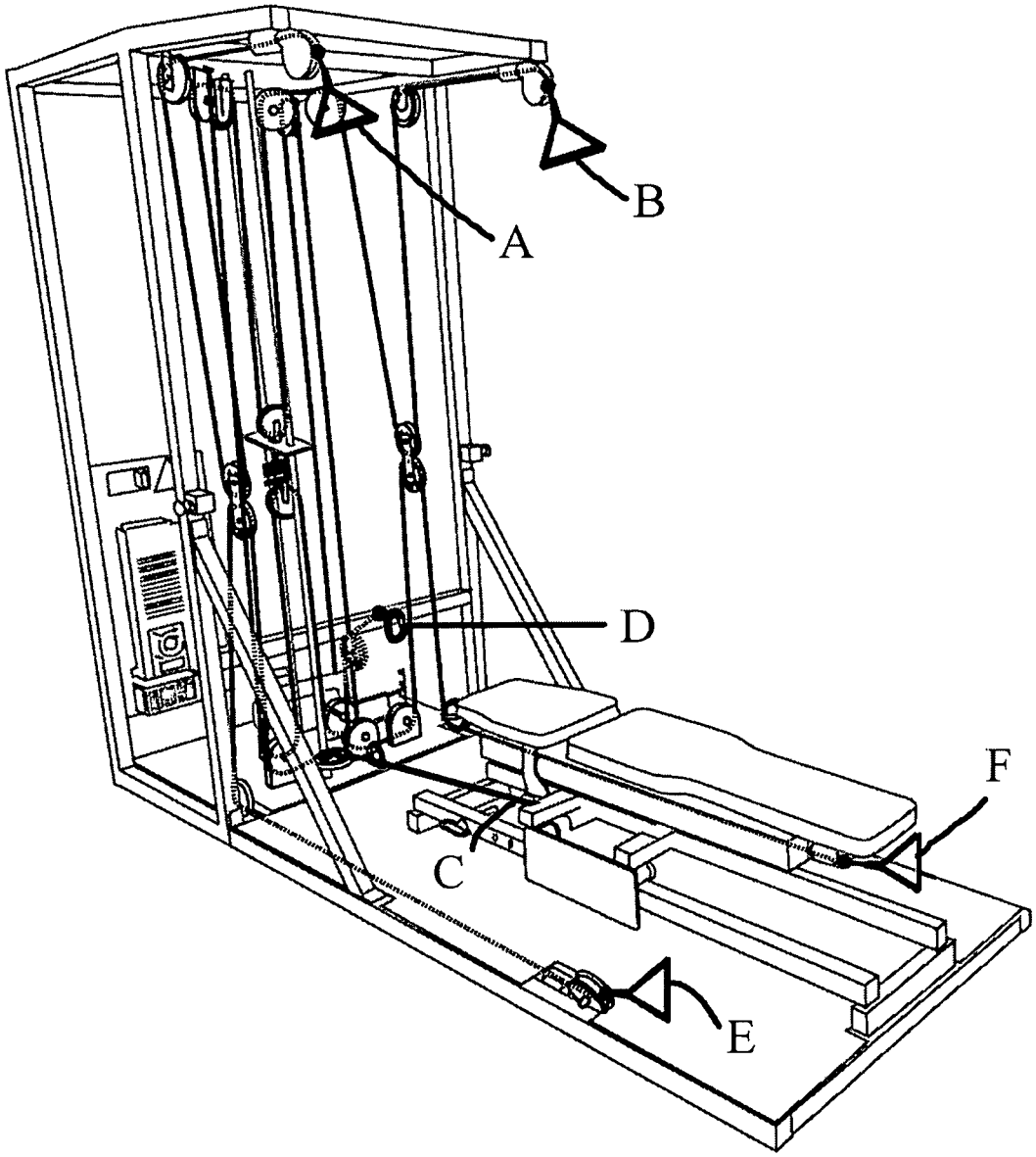
FIG. 20 a perspective view of an exercise system provided by and useful in accordance with some embodiments of the disclosure
Figure 21:
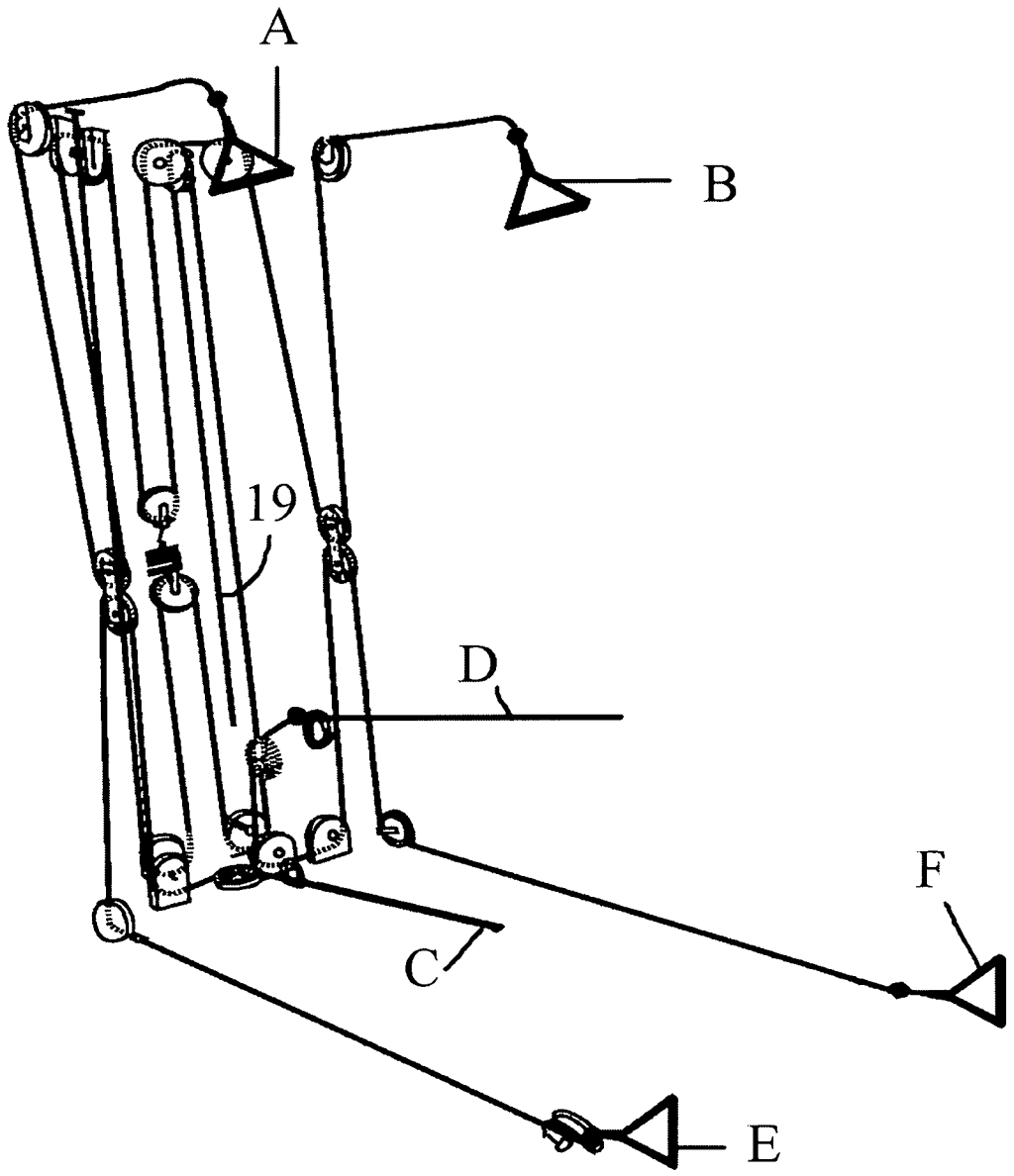
FIG. 21 is a perspective view of a pulley and cable network useful in accordance with some alternate embodiments, wherein the framework from FIG. 20 has been omitted for clarity

The instant technology is adaptable to a wide variety and range of possible framework structures, subject to the main proviso that any proposed framework should have provisions for providing stationary pulleys as generally shown depicted in FIGS. 4, 22 and permitting routing of the cables and wares sufficiently to achieve the functionality herein described. Thus, the versatility of the instant technology to be adapted to different structures is illustrated without limitation by the framework 220 shown in FIG. 18. Here are shown a base portion 229 which while depicted as being rectangular, can take on any geometric shape desired. There are vertical supports 231, 233, 235, 237 and horizontal supports 253, 255. Angled supports such as those illustrated by 239, 241 can be provided for increased rigidity, and an upper framework portion including frame member 245 and those adjacent can be employed to achieve any desired upper portion configuration. In some embodiments, a bench 247 is provided, slidably mounted to rails 249, 251, which bench 247 is attached to cable at C as shown in FIGS. 20, 21, 22. In FIG. 19, framework 220 is shown being further provided with foot pad 257, which in some embodiments is a metal plate, upon which a user can place their feet when residing on bench 247, to work against resistance provided at the location C on the cable as shown in FIGS. 20, 21, 22 to perform leg press exercises. Also shown in FIG. 19 is a location at which controls 253 can be present, as well as a display screen 255 onto which data from the system is displayed to a user.

Figure 18:
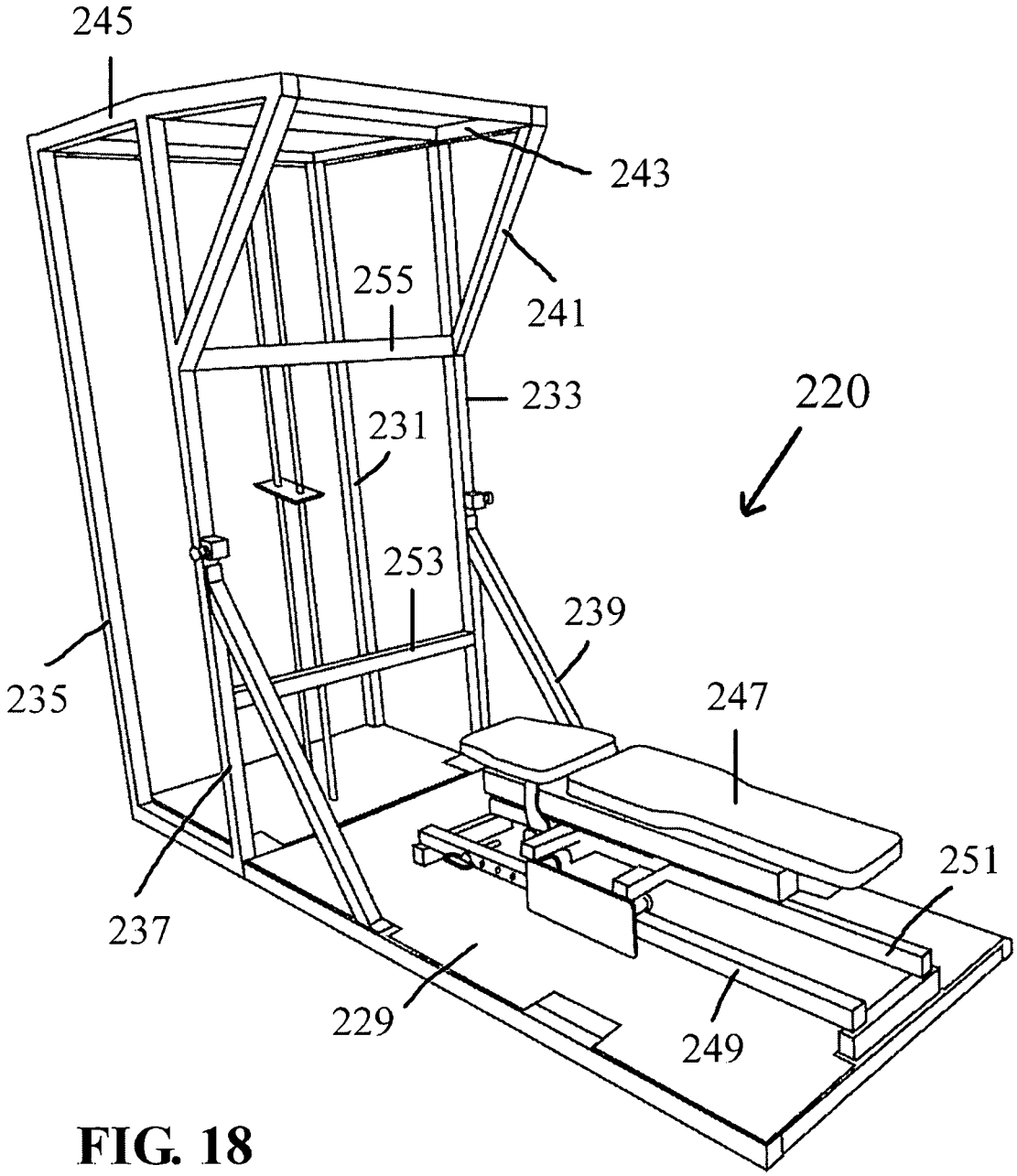
FIG. 18 is a perspective view of an exercise system framework useful in some alternate embodiments of the invention.

FIG. 20 shows the framework 220 from FIG. 18 being further provided with necessary cabling and pulleys to enable the various exercise modalities and data collection herein described. For clarity, these wares are shown in the stand-alone perspective view of FIG. 21, the runs of which are shown in schematic view of FIG. 22. In FIG. 22, the sigma-shaped connector between central mobile pulley 43 and mobile pulley 221 in some embodiments represents a load cell 213 which is an input to microprocessor 197 (FIG. 12). Similarly, where else appears such a sigma-shaped connector in the various figures, those features can also represent load cell 213 in some embodiments.

From FIG. 22 it is seen that in that embodiment, there is a single cable disposed between resistance access points A and B, and there is a single cable disposed between resistance access points C and E, and there is a single cable disposed between resistance access points F and D. The resistances provided these points are ultimately influenced by cable 19, which at one end is attached rigidly such as to a frame member at attachment point AP, and the shaft of motor 25.

FIG. 23 illustrates an alternate embodiment for cable 19 to drive pulley 43 in the various embodiments described. In this FIG. 23 is shown motor 25, and motor shaft 26. Pulleys 43 and 221 are independently rotatable from one another and are attached to one another at axles through their axes, which attachment can be a plate of metal, and alternatively a plate of metal disposed towards the front and rear of each of pulleys 43, 221. Three stationary pulleys labeled SP are rigidly attached to framework members FW, and the end of cable 19 that is not wound around shaft 26 is attached to a frame member FW by means of, or through, load cell 213, which load cell 213 is itself rigidly attached to the frame, as shown. In this configuration, load cell 213 experiences one-half (½) of the total load on the machine, which permits utilization of a load cell having a lower maximum limit, i.e., a load cell rated for 1,500 pounds can be used with a device as herein described when loads of 3,000 pounds are encountered.

Consideration must be given to the fact that although this invention has been described and disclosed in relation to certain preferred embodiments, equivalent modifications and alterations thereof may become apparent to persons of ordinary skill in this art after reading and understanding the teachings of this specification, drawings, and the claims appended hereto. The present disclosure includes subject matter defined by any combinations of any one or more of the features provided in this disclosure with any one or more of any other features provided in this disclosure. These combinations include the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. These combinations also include combination of the features and/or limitations of one or more of the independent claims with features and/or limitations of another independent claims to arrive at a modified independent claim, with the remaining dependent claims in their original text or as modified per the foregoing, being read and applied to any independent claim so modified. The present invention has been disclosed and claimed with the intent to cover modifications and alterations that achieve substantially the same result as herein taught using substantially the same or similar structures, being limited only by the scope of the claims which follow.

The invention claimed is:

1. An exercise machine for enhancing physical fitness of a human subject, said machine being selectively operable in any mode selected from the group consisting of: isokinetic mode, isometric mode, isotonic mode, and isoinertial mode, and combinations thereof, said machine comprising:

a) a rigid frame;

b) an electrical motor attached to said frame, said motor having a motor shaft;

c) a microprocessor having inputs and outputs, in effective electrical communication with said motor sufficiently to effect selective control of the direction of rotation, speed of rotation, and torque output of said motor;

d) computer-readable memory in effective electrical communication with said microprocessor;

e) a position sensor configured to determine the position of said motor shaft, said position sensor having an output which is provided as an input to said microprocessor;

f) a torque sensor configured to determine the torque output of said motor, said torque sensor having an output which is provided as an input to said microprocessor;

g) a first cable having a first end and a second end, said first and said second ends of said first cable each comprising a resistance access point, said first cable being attached to said frame by a plurality of stationary pulleys attached to said frame, and wherein said first cable is routed around a first mobile pulley, a central mobile pulley, and a second mobile pulley;

h) a second cable having a first end and a second end, said first and said second ends of said second cable each comprising a resistance access point, said second cable being attached to said frame by a plurality of stationary pulleys attached to said frame, and wherein said second cable is routed around a third mobile pulley;

i) a third cable having a first end and a second end, said first and said second ends of said third cable each comprising a resistance access point, said third cable being attached to said frame by a plurality of stationary pulleys attached to said frame, and wherein said third cable is routed around a fourth mobile pulley;

j) a fourth cable having a first end and second end, wherein said first end of said fourth cable is attached to said shaft of said motor, and wherein said fourth cable is in effective mechanical contact with said central mobile pulley sufficiently to cause changes in the tension of said first cable, said second cable, and said third cable responsive to the torque output of said motor;

k) a load cell configured to determine force experienced by said central mobile pulley, said load cell having an output which is provided as an input to said microprocessor, said microprocessor being configured to selectively and independently cause changes in any one, or more than one output of said motor selected from the group consisting of: direction of rotation, speed of rotation, and torque output, responsive to changing forces applied by a human subject to any of said resistance access points.

2. An exercise machine according to claim 1, wherein said microprocessor is configured to command said motor to enable a human subject applying repetitive force to any of said resistance access points to selectively experience any exercise modality selected from the group consisting of: isotonic exercises, isokinetic exercises, isoinertial exercises, isometric exercises, and any hybrid combination of the foregoing.

3. An exercise machine according to claim 2 wherein said microprocessor is configured to command said motor to cease applying torque to said fourth cable responsive to cessation of said subject applying force to any of said resistance access points.

4. An exercise machine according to claim 2 wherein said microprocessor is configured to cause said motor to output a greater amount of torque during the eccentric phase of an appropriate selected exercise modality than is output during the concentric phase of said selected exercise modality.

5. An exercise machine according to claim 2 wherein said microprocessor is configured to effect changes in said output of said motor such that said subject experiences a differential isotonic exercise modality, and wherein said microprocessor is configured to cause said motor to output a greater amount of torque during the eccentric phase than is output during the concentric phase of said differential isotonic exercise modality.

6. An exercise machine according to claim 5 wherein said microprocessor is configured to determine the range of motion of a limb of a human subject applying a cyclic force to any selected resistance access point, said microprocessor being further configured to cause said motor to output a greater amount of torque during the eccentric phase than is output during the concentric phase of differential isotonic exercise modality, responsive to the position of said limb within said range of motion.

7. An exercise machine according to claim 2, wherein said microprocessor is configured to determine the amount of force applied by a human subject to any selected resistance access point, wherein said selected modality is an isotonic exercise, said microprocessor being further configured to command said motor to take up excess amount of said fourth cable upon cessation of application of force by said human subject that meets a pre-selected threshold force.

8. An exercise machine according to claim 2 wherein said microprocessor is configured to determine and store in memory a range of motion for a limb of a human subject applying a cyclic force to any selected resistance access point for a selected exercise modality, said microprocessor being further configured to determine and store in memory the amount of force applied by a human subject to said selected resistance access point at any selected points in time, thereby generating stored performance data resident in computer memory relating to the performance of said subject for a particular exercise selected, during a plurality of separate discrete time intervals.

9. An exercise machine according to claim 8 further comprising a display, and wherein said microprocessor is further configured to generate graphical images reflective of said stored performance data, said images being displayed sufficiently to enable said subject to make a visual comparison of their performance over any selected time interval to that over another, different selected time interval.

10. An exercise machine according to claim 1, wherein said microprocessor is configured to determine and store in memory a range of motion for a limb of a human subject applying a cyclic force to any selected resistance access point, the extreme extended position of said range of motion representing the maximum extension of said fourth cable for said cyclic force.

11. An exercise machine according to claim 10, wherein said microprocessor is configured to determine the exact position of a limb of a human subject applying a force to any selected resistance access point, at any moment in time within said range of motion.

12. An exercise machine according to claim 11, wherein said microprocessor is configured to cause the torque output of said motor to change responsive to the position of said subject's limb within said range of motion.

13. An exercise machine according to claim 10, wherein said microprocessor is configured to command said motor to not permit the length of said fourth cable extended to any amount greater than that amount extended at said maximum extension.

14. An exercise machine according to claim 1, wherein said microprocessor is configured to determine the acceleration of said fourth cable, said microprocessor being further configured to command said motor to cease torque output responsive to acceleration of said fourth cable exceeding a pre-determined threshold acceleration stored in said memory.

15. An exercise machine according to claim 1, wherein said microprocessor is configured to determine the amount of force applied by a human subject to any selected resistance access point at any selected points in time.

16. An exercise machine according to claim 15, wherein said microprocessor is further configured to determine and store in memory a range of motion for a limb of a human subject applying a cyclic force to any selected resistance access point, said microprocessor being further configured to command said motor to output a torque which results in the same amount of force being applied to said selected resistance access point as is being applied by said human subject, throughout at least a portion of said range of motion.

17. An exercise machine according to claim 1, wherein said microprocessor is configured to determine and store in memory a range of motion for a limb of a human subject applying a cyclic force to any selected resistance access point, the extreme retracted position of said range of motion representing the minimum extension of said fourth cable for said cyclic force.

18. An exercise machine according to claim 17, wherein said microprocessor is configured to command said motor to not permit the length of said fourth cable extended to be any amount less than that amount extended at said minimum extension.

* * * * *